US007903995B2

(12) United States Patent
Nakamatsu et al.

(10) Patent No.: US 7,903,995 B2
(45) Date of Patent: Mar. 8, 2011

(54) CLEANING DEVICE, IMAGE FORMING APPARATUS, AND PROCESS CARTRIDGE

(75) Inventors: Hiroki Nakamatsu, Fujisawa (JP); Kenji Sugiura, Yokohama (JP); Naomi Sugimoto, Kawasaki (JP); Osamu Naruse, Yokohama (JP); Hidetoshi Yano, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 65 days.

(21) Appl. No.: 12/490,543

(22) Filed: Jun. 24, 2009

(65) Prior Publication Data

US 2010/0003052 A1 Jan. 7, 2010

(30) Foreign Application Priority Data

Jul. 3, 2008 (JP) ..... 2008-174510

(51) Int. Cl.
*G03G 15/16* (2006.01)
*G03G 21/00* (2006.01)

(52) U.S. Cl. ..... 399/101; 399/343; 399/354

(58) Field of Classification Search ..... 399/101, 399/350–354

See application file for complete search history.

(56) References Cited

U.S. PATENT DOCUMENTS

| | | | | |
|---|---|---|---|---|
| 5,233,398 | A * | 8/1993 | Nimura et al. | 399/354 |
| 7,668,480 | B2 * | 2/2010 | Nakayama et al. | 399/101 |
| 2007/0212139 | A1 | 9/2007 | Sugiura et al. | |
| 2008/0170878 | A1 | 7/2008 | Yamashita et al. | |
| 2008/0193178 | A1 | 8/2008 | Sugimoto et al. | |
| 2008/0193179 | A1 | 8/2008 | Sugimoto et al. | |
| 2008/0253815 | A1 | 10/2008 | Yano et al. | |
| 2008/0310897 | A1 | 12/2008 | Naruse et al. | |
| 2009/0035038 | A1 | 2/2009 | Sugimoto et al. | |
| 2009/0092428 | A1 | 4/2009 | Yano et al. | |
| 2009/0116872 | A1 | 5/2009 | Sugimoto et al. | |

FOREIGN PATENT DOCUMENTS

| | | |
|---|---|---|
| JP | 2002-202702 | 7/2002 |
| JP | 3466825 | 8/2003 |
| JP | 2005-265907 | 9/2005 |
| JP | 3994974 | 8/2007 |

* cited by examiner

*Primary Examiner* — Hoang Ngo
(74) *Attorney, Agent, or Firm* — Dickstein Shapiro LLP

(57) ABSTRACT

A cleaning device including a conductive member configured to charge powder remaining on a member to be cleaned so as to have a single polarity and configured to scrape off at least part of the powder, and disposed to contact with the member to be cleaned; a cleaning member configured to electrically adsorb the powder present on the member to be cleaned, disposed to contact with the member to be cleaned and located downstream of the conductive member in a direction in which the powder is conveyed thereon; a first recovering member configured to electrically adsorb the powder present on the cleaning member and disposed to contact with the cleaning member; and a second recovering member configured to scrape off the powder from the first recovering member and disposed to contact with the first recovering member, wherein the conductive member is constant-current controlled.

17 Claims, 14 Drawing Sheets

$$SF1=[(MXLNG)^2/AREA]*(100\pi/4)$$

CLEANING DEVICE, IMAGE FORMING APPARATUS, AND PROCESS CARTRIDGE

BACKGROUND OF THE INVENTION

1. Field of the Invention

The present invention relates to a cleaning device employing an electrostatic cleaning method; an image forming apparatus containing the cleaning device; and a process cartridge containing the cleaning device.

2. Description of the Related Art

In recent years, electrophotographic image forming apparatuses, which are employed, for example, in copiers, printers, plotters, facsimiles and complex machines having the functions thereof, have been increasingly being required to form an image of higher quality. In view of this, toner particles (i.e., coloring powder) used for image formation tend to have a smaller particle diameter. Also, in an attempt to reduce the production cost for toner and to increase the transfer rate thereof, some commercially available image forming apparatuses employ, rather than pulverized toner particles, spherical toner particles produced through, for example, the polymerization method. Meanwhile, in order to remove toner particles remaining after image formation on the surface of an image bearing member (e.g., a photoconductor), a blade cleaning method has conventionally been employed in many cases. The blade cleaning method removes toner particles by bringing a rubber blade into contact with the photoconductor surface. When the blade insufficiently comes into contact with the photoconductor surface, the spherical toner particles run through the contact portion therebetween, resulting in that the cleaning performance is prone to degrade.

When pressed against the photoconductor surface at a high contact pressure to avoid the above unfavorable phenomenon, the blade is undesirably warped to cause cleaning failures such as formation of streaky or belt-like scratches, making it difficult to stably attain desired cleaning performance. Such spherical toner particles can be cleaned when the linear pressure is considerably increased. But, in this case, the service life of an image forming apparatus using them becomes very short due to, for example, abrasion of a photoconductor drum and a cleaning blade. Further, as has been well known, spherical toner particles excellent in transferability are less cleaned with a blade than are pulverized (amorphous) toner particles.

Separately, there is known a brush cleaning method which reduces abrasion of the photoconductor surface and reliably removes spherical toner particles having a small particle diameter. The brush cleaning method is performed based, for example, on the following configuration: a brush roller is disposed so as to slidably contact with the photoconductor surface; a recovering roller is disposed so as to be in contact with the brush roller; and a rubber blade or another unit is disposed so as to remove toner particles from the recovering roller. In this configuration, cleaning is performed utilizing electrostatic force brought by applying a voltage to the recovering roller or both the recovering roller and the brush roller, which is advantageous in use of spherical toner particles, etc.

As has been well known, the voltage applied in a common transfer step has an opposite polarity to that of the toner after development and thus, the remaining toner particles on the photoconductor surface after transfer are a mixture of toner particles having the same polarity as those after development, toner particles having an opposite polarity to them, and toner particles having no polarity.

Various attempts have been made to clean such a mixture that contains positively-charged, negatively-charged, and non-charged toner particles.

For example, Japanese Patent Application Laid-Open (JP-A) No. 2002-202702 discloses an image forming device including a conductive cleaning blade positively (negatively) charged and a conductive cleaning roller negatively (positively) charged, the conductive cleaning blade being disposed upstream of the conductive cleaning roller in a direction in which a photoconductor is rotated, wherein the conductive cleaning roller charges the remaining toner particles, which have not been removed with the conductive cleaning blade, so as to have a single polarity, and then cleans them.

Japanese Patent (JP-B) No. 3994974 discloses an image forming apparatus including a conductive rotating member which is driven so as to rotate with being in contact with a surface of an image bearing member; a conductive member which is in contact with the image bearing member at a position upstream of the rotating member in a direction in which the image bearing member is moved; and a single DC constant current power source bound to one of the conductive rotating member and the conductive member, the other being connected to the ground. In this image forming apparatus, the single DC constant current power source generates a DC electric current flowing between the conductive rotating member and the conductive member via the image bearing member, forming a first electrical field, between the conductive rotating member and the image bearing member, which acts in a direction in which regularly charged toner particles are adsorbed on the conductive rotating member; and a second electrical field, between the conductive member and the image bearing member, which acts in a direction in which regularly charged toner particles are adsorbed on the image bearing member.

JP-B No. 3466825 discloses an image forming apparatus including a first image bearing member, a second image bearing member, a third image bearing member, a transfer unit, and a toner-recovering unit, wherein a toner image formed on the first image bearing member is primarily transferred onto the second image bearing member at a primary transfer portion between the first and second image bearing members; the transfer unit is configured to secondarily transfer the toner image from the second image bearing member onto the third image bearing member; and the toner-recovering unit is configured to contact-charging the toner particles remaining after secondary transfer on the second image bearing member. In this image forming apparatus, the remaining toner particles charged by the toner-recovering unit are recovered from the primary transfer portion to the image bearing member. Here, the toner-recovering unit includes a cleaning charging member and a charging bias power source for applying a voltage to the cleaning charging member, wherein the charging bias power source applies, to the cleaning charging member, a voltage obtained by superimposing an AC voltage on a DC voltage. Also, the DC voltage is constant-current controlled, and the AC voltage is constant-voltage controlled.

JP-A No. 2005-265907 discloses a cleaning method including controlling, through corotron charging which applies a voltage to a corona charger, the charge amount of toner to be cleaned; and cleaning positively and negatively charged toner particles using two brushes arranged in a row, one of the two brushes being positively charged for cleaning the negatively charged toner particles and the other being negatively charged for cleaning the positively charged toner particles.

The method disclosed in JP-A No. 2005-265907 can satisfactorily clean a mixture of positively-charged, negatively-charged, and non-charged toner particles. However, such a configuration that two brushes are arranged so as to face a photoconductor and toner-recovering devices for recovering toner particles adhering to the brushes are disposed cannot easily attain downsizing of image forming apparatuses.

BRIEF SUMMARY OF THE INVENTION

In recent years, photoconductor drums tend to be small in diameter in an attempt to downsize image forming apparatuses. In view of this, cleaning devices to be used are required to be small. In addition to the system described in JP-A No. 2005-265907 which has two brushes and corresponding recovering rollers thereto, some cleaning systems attempt to achieve more downsizing of image forming apparatuses as follows. Specifically, remaining toner particles are charged so as to have a single polarity by a toner polarity controlling blade to which a voltage is applied, and then the resultant toner particles are cleaned by an electrostatic cleaning device disposed downstream of the blade. One such electrostatic cleaning device uses a brush roller and a recovering roller which are given a predetermined voltage to form the difference in electrical potential therebetween. In this cleaning device, toner particles on a photoconductor are made to adhere to the brush roller, and then are recovered by the recovering roller.

Here, presumably, toner particles having undergone polarity control advantageously have a charge distribution covering a certain range of the horizontal axis. In an electrostatic cleaning part after polarity control, charge injection into toner particles occurs, in principle, to no small extent between the photoconductor drum and the brush roller and between the brush roller and the recovering roller, the degree of the charge injection depending on the intensity of voltage applied to each member (here, no detail description therefor is given). Thus, the toner particles having undergone polarity control may have a q/d distribution covering a certain range slightly distant from "0 fC/μm," specifically may have a q/d distribution of "−0.2 fC/μm" or higher as an absolute value. The toner particles having such a q/d distribution remain negatively charged without inversion of their polarity even after charge injection slightly occurs as described above. Also, toner particles with a q/d distribution covering a higher range (i.e., more shifted to the left-hand side) have an increased charge amount. Such toner particles firmly adhere to a photoconductor drum and thus, are difficult to clean with the aid of electrostatic force brought by a brush roller. Therefore, the q/d distribution may have an upper limit, which is specifically "−0.8 fC/μm." That is, when toner particles having undergone polarity control are controlled to have a q/d distribution of "−0.2 fC/μm to −0.8 fC/μm," desired cleaning performance is attained.

Here, toner polarity controlling performance depends on the difference in electrical potential between the photoconductor surface and the toner polarity controlling blade. And, the greater the difference in electrical potential, the more toner particles are negatively charged. However, the photoconductor surface fluctuates in its electrical potential depending on the image area ratio and the presence or absence of a transfer current. As a result, there cannot be obtained such a difference in electrical potential that enables toner particles to have a q/d distribution falling within the above range, which problematically cause insufficient polarity control (problem 1).

Also, the cleaning performance of the electrostatic cleaning device depends on the difference in electrical potential between the brush roller and a portion of the photoconductor surface, the portion being a portion which has passed the toner polarity controlling blade. When the difference in electrical potential is too small, toner particles cannot be moved. Whereas when it is too great, the polarity of toner particles changes due to charge injection thereto. For this reason, there is an optimal difference in electrical potential. Meanwhile, the toner polarity controlling blade changes in resistance over time as a result of toner adhesion and application of voltage. The current value of the blade changes with a change in resistance, changing the surface potential of a portion of the photoconductor surface, the portion being a portion which has passed the toner polarity controlling blade. Thus, the difference in electrical potential also changes between the photoconductor surface and the brush roller, problematically leading to poor cleaning performance (problem 2).

Further, since the toner polarity controlling blade changes in resistance over time due to toner adhesion and application of voltage, and the current value of the blade changes with a change in resistance, the blade exhibits degraded toner polarity controlling performance, leading to poor cleaning performance (problem 3).

The present invention has been made in view of the foregoing. An object of the present invention is to provide a cleaning device having such a configuration that it exhibits a long-term, excellent cleaning performance by appropriately applying a voltage to a toner polarity controlling blade to solve the above problems; an image forming apparatus containing the cleaning device; and a process cartridge containing the cleaning device.

Means for solving the above-described problems are as follows.

<1> A cleaning device which removes and recovers powder remaining after image formation on a member to be cleaned, with being mounted to an image forming apparatus performing image formation using coloring powder, the cleaning device including:

a conductive member configured to charge the powder remaining on the member to be cleaned through application of a predetermined voltage so as to have a single polarity and configured to scrape off at least part of the powder remaining on the member to be cleaned, the conductive member being disposed so as to be in contact with the member to be cleaned;

a cleaning member configured to electrically adsorb the powder present on the member to be cleaned through application of a predetermined voltage, the cleaning member being disposed so as to be in contact with the member to be cleaned and located downstream of the conductive member in a direction in which the powder is conveyed on the member to be cleaned;

a first recovering member configured to electrically adsorb the powder present on the cleaning member through application of a predetermined voltage, the first recovering member being disposed so as to be in contact with the cleaning member; and a second recovering member configured to scrape off the powder from the first recovering member through application of a predetermined voltage, the second recovering member being disposed so as to be in contact with the first recovering member, wherein the conductive member is constant-current controlled.

<2> The cleaning device according to <1> above, wherein the member to be cleaned is any one of an image bearing member on which an image is formed with the coloring powder and which transfers the image onto an intermediate transfer member or a recording medium; an intermediate transfer member onto which the image on the image bearing member is transferred; and a transfer member which conveys a recording medium and transfers, onto the recording medium, the image on the image bearing member or the intermediate transfer member.

<3> The cleaning device according to any one of <1> and <2> above, wherein the coloring powder is a toner having a shape factor 1 (SF1) of 100 to 150.

<4> The cleaning device according to any one of <1> to <3> above, wherein the member to be cleaned is an image bearing member which is a photoconductor, and the cleaning device further includes a quenching member configured to quench the image bearing member, the quenching member being provided downstream of the conductive member but upstream of the cleaning member in a direction in which the image bearing member is rotated.

<5> An image forming apparatus including:

an image bearing member, an image forming unit configured to form an image with coloring powder on the image bearing member, a transfer unit configured to transfer the image formed on the image bearing member onto a recording medium, and a cleaning unit configured to remove and recover powder remaining on a member to be cleaned, wherein the cleaning unit is the cleaning device according to any one of <1> to <4> above.

<6> An image forming apparatus including:

an image bearing member, an image forming unit configured to form an image with coloring powder on the image bearing member, a transfer unit configured to transfer the image formed on the image bearing member onto a recording medium directly or via an intermediate transfer member, and a cleaning unit configured to remove and recover powder remaining on the image bearing member from which the image has been transferred onto the recording medium or the intermediate transfer member, wherein the cleaning unit is the cleaning device according to any one of <1> to <4> above.

<7> An image forming apparatus including:

an image bearing member, an image forming unit configured to form an image with coloring powder on the image bearing member, a transfer member configured to carry and convey a recording medium and to transfer the image formed on the image bearing member onto the recording medium, and a cleaning unit configured to remove and recover powder remaining on the transfer member which has conveyed the recording medium, wherein the cleaning unit is the cleaning device according to any one of <1> to <3> above.

<8> An image forming apparatus including:

an image bearing member, an image forming unit configured to form an image with coloring powder on the image bearing member, a transfer unit configured to transfer the image formed on the image bearing member onto an intermediate transfer member, a transfer unit configured to transfer the transferred image on the intermediate transfer member onto a recording medium, and a cleaning unit configured to remove and recover powder remaining on the intermediate transfer member from which the transferred image has been transferred onto the recording medium, wherein the cleaning unit is the cleaning device according to any one of <1> to <3> above.

<9> An image forming apparatus including:

one image bearing member, a plurality of developing units configured to form images with coloring powder on the image bearing member, a transfer unit configured to transfer the images formed on the image bearing member onto a recording medium directly or via an intermediate transfer member, and a cleaning unit configured to remove and recover powder remaining on the image bearing member from which the images have been transferred onto the recording medium or the intermediate transfer member, wherein the cleaning unit is the cleaning device according to any one of <1> to <4> above.

<10> An image forming apparatus including:

one image bearing member, a plurality of developing units configured to form images with coloring powder on the image bearing member, a transfer unit configured to transfer the images formed on the image bearing member onto an intermediate transfer member, a transfer unit configured to transfer the transferred images on the intermediate transfer member onto a recording medium, and a cleaning unit configured to remove and recover powder remaining on the intermediate transfer member from which the transferred images have been transferred onto the recording medium, wherein the cleaning unit is the cleaning device according to any one of <1> to <3> above.

<11> An image forming apparatus including:

a plurality of image forming sections each having at least one image bearing member and at least one developing unit configured to form at least one image with coloring powder on the at least one image bearing member, a transfer unit configured to sequentially transfer images formed on the image bearing members of the image forming sections onto a recording medium or an intermediate transfer member in a superposed manner, and a cleaning unit configured to remove and recover powder remaining on the image bearing members from which the images have been transferred onto the recording medium or the intermediate transfer member.

wherein the cleaning unit is the cleaning device according to any one of <1> to <4> above.

<12> An image forming apparatus including:

a plurality of image forming sections each having at least one image bearing member and at least one developing unit configured to form at least one image with coloring powder on the at least one image bearing member, a transfer member configured to convey a recording medium sequentially to the image forming sections and sequentially transfers images formed on the image bearing members onto the recording medium in a superposed manner, and a cleaning unit configured to remove and recover powder remaining on the transfer member which has conveyed the recording medium, wherein the cleaning unit is the cleaning device according to any one of <1> to <3> above.

<13> An image forming apparatus including:

a plurality of image forming sections each having at least one image bearing member and at least one developing unit configured to form at least one image with coloring powder on the at least one image bearing member, a transfer unit configured to sequentially transfer images formed on the image bearing members of the image forming sections onto an intermediate transfer member in a superposed manner, a transfer unit configured to transfer the transferred image on the intermediate transfer member onto a recording medium at one time, and a cleaning unit configured to remove and recover powder remaining on the intermediate member from which the transferred image has been transferred onto the recording medium, wherein the cleaning unit is the cleaning device according to any one of <1> to <3> above.

<14> The image forming apparatus according to any one of <5> to <13> above, wherein the image bearing member or the image bearing members are a photoconductor in which a filler is dispersed.

<15> The image forming apparatus according to any one of 5<5> to <13> above, wherein the image bearing member or the image bearing members are an organic photoconductor having a surface layer reinforced with a filling material, an organic photoconductor containing a cross-linkable charge transport material, or an organic photoconductor having a surface layer reinforced with a filling material and containing a cross-linkable charge transport material.

<16> The image forming apparatus according to any one of <5> to <13> above, wherein the image bearing member or the image bearing members are an amorphous silicon photoconductor.

<17> A process cartridge detachably mounted to an image forming apparatus main body, the process cartridge including:

an image bearing member, a cleaning unit for the image bearing member, and at least one unit selected from a charging unit and a developing unit, the image bearing member, the cleaning unit, and the at least one unit being integrally supported, wherein the cleaning unit is the cleaning device according to any one of <1> to <4> above.

<18> An image forming apparatus including:

the process cartridge according to <17> above.

A cleaning device of the present invention includes a conductive member (e.g., a toner polarity controlling blade) which is disposed so as to be in contact with a member to be cleaned, a cleaning member (e.g., a cleaning brush roller) which is disposed so as to be in contact with the member to be cleaned and which is located downstream of the conductive member in a direction in which powder is conveyed on the member to be cleaned, a first recovering member (e.g., a recovering roller) which is disposed so as to be in contact with the cleaning member, and a second recovering member (e.g., a recovering roller conductive cleaning blade) which is disposed so as to be in contact with the first recovering member. Here, the member to be cleaned is an image bearing member (e.g., a photoconductor) on which an image is formed with coloring powder (toner) and which transfers the image onto an intermediate transfer member or a recording medium, an intermediate transfer member (e.g., an intermediate transfer belt or an intermediate transfer drum) onto which an image on an image bearing member is transferred, or a transfer member (e.g., a transfer belt) which conveys a recording medium and transfers, onto the recording medium, an image on an image bearing member or an intermediate transfer member. The conductive member is configured to charge powder remaining on the member to be cleaned through application of a predetermined voltage so as to have a single polarity (i.e., so that the remaining powder is either positively or negatively charged) and configured to scrape off at least part of the remaining powder. The cleaning member is configured to electrically adsorb powder present on the member to be cleaned through application of a predetermined voltage. The first recovering member is configured to electrically adsorb powder present on the cleaning member through application of a predetermined voltage. The second recovering member is configured to scrape off powder from the first recovering member through application of a predetermined voltage. The cleaning device is characterized in that the conductive member (e.g., a toner polarity controlling blade) is constant-current controlled. When a voltage is applied to the conductive member (e.g., a toner polarity controlling blade) through constant current control, the difference in electrical potential is maintained almost constant between the surface of the member to be cleaned and the conductive member (toner polarity controlling blade). As a result, the conductive member stably exhibits its polarity controlling performance, achieving stable cleaning performance.

The present invention, therefore, realizes a cleaning device having such a configuration that it exhibits desired cleaning performance for a long period of time; an image forming apparatus containing the cleaning device; and a process cartridge containing the cleaning device.

DETAILED DESCRIPTION OF THE INVENTION

With reference to the drawings, next will be described in detail the configuration, operation and effect of a cleaning device (an image forming apparatus) of the present invention.

Figure 1:
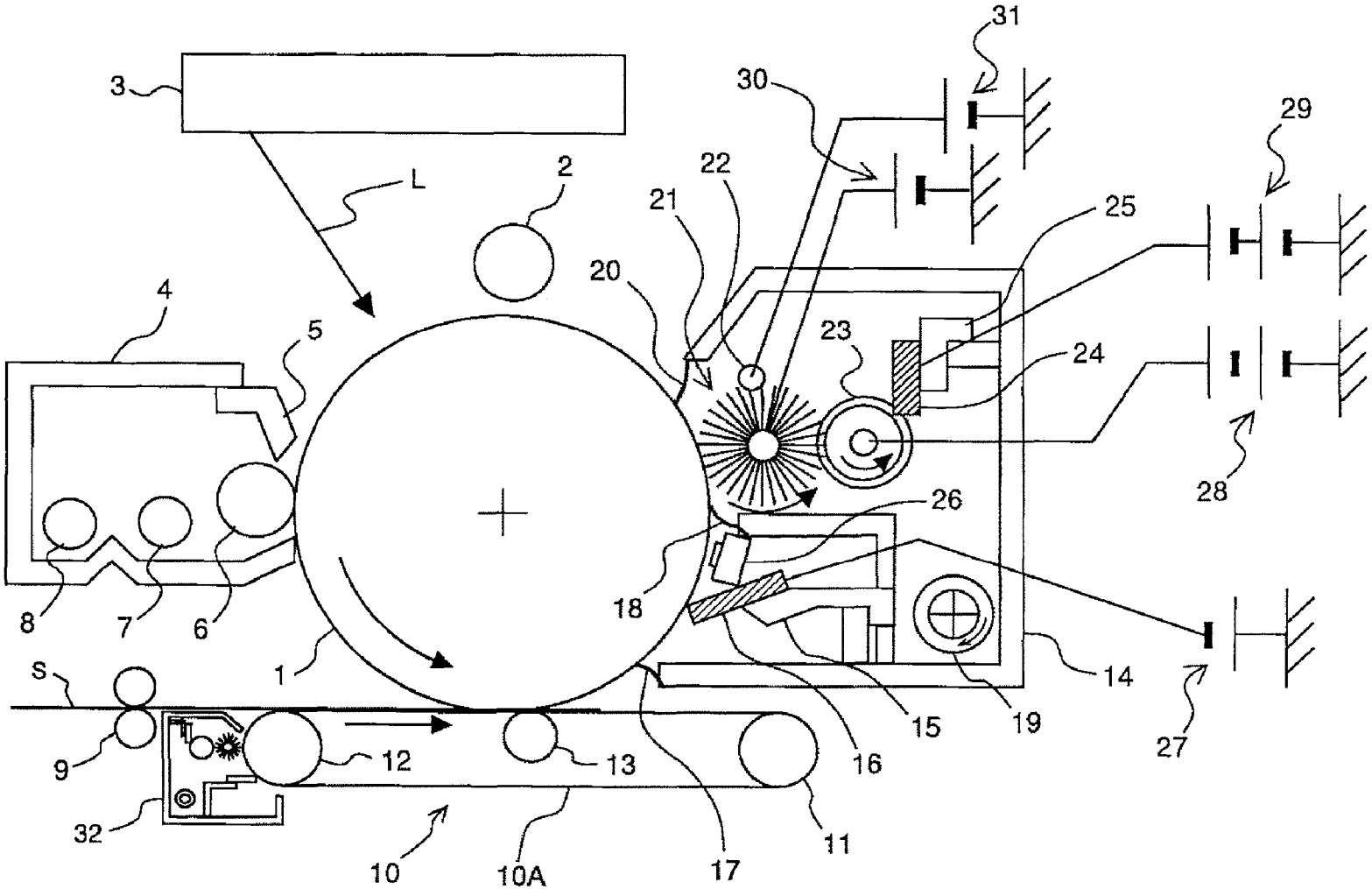
FIG. 1 schematically illustrates essential parts of an exemplary image forming apparatus employing a cleaning device of the present invention.

FIG. 1 schematically illustrates essential parts of an exemplary image forming apparatus employing a cleaning device of the present invention. In FIG. 1, reference numeral 1 denotes an image bearing member. Around the image bearing member 1 are disposed, for example, a charging unit 2, an optical writing unit 3, a developing unit 4, a transfer unit 10 and a cleaning unit 14.

The image bearing member 1 is a photoconductor drum and is rotated counterclockwise; i.e., in a direction indicated by an arrow in FIG. 1.

The charging unit 2 is, for example, a charging roller disposed in a non-contact manner, and uniformly charges the surface of the photoconductor drum 1.

The optical writing unit 3 is, for example, an optical writing device employing laser light scanning which includes a laser light source, a coupling optical system, a light polarizer and a scanning imaging optical system. This applies laser light L, which is modulated correspondingly to image signals, to a charged photoconductor drum 1 to form a latent electrostatic image.

The developing unit 4 is a developing device containing, in a case, a coloring powder; i.e., a toner used as a one- or two-component developer. The case houses, for example, a developing roller 6 for carrying/conveying a developer to develop a latent image on the photoconductor drum with toner; a doctor blade 5 for controlling the amount of the developer carried on the developing roller; and developing screws 7 and 8 which stir the developer to convey it.

The transfer unit 10 is a transfer device 10 using a transfer belt 10A. The transfer device carries/conveys a recording medium (e.g., a recording paper sheet) S which has been fed by an unillustrated paper feeding mechanism, and transfers, onto the recording medium S, an image (a toner image) on the photoconductor drum. The transfer belt 10A is rotated in a direction indicated by an arrow in FIG. 1, with being supported by a driving roller 11, a driven roller 12 and a transfer bias-applying roller 13.

The cleaning unit 14 for the image bearing member is a cleaning device which includes a toner polarity controlling blade 16 disposed so as to be in contact with the photoconductor drum 1 to be cleaned; a cleaning brush roller 21 which is disposed so as to be in contact with the photoconductor drum 1 and which is located downstream of the toner polarity controlling blade 16 in a direction in which a toner is conveyed on the photoconductor drum; a recovering roller 23 disposed so as to be in contact with the cleaning brush roller 21; and a recovering roller conductive cleaning blade 24 disposed so as to be in contact with the recovering roller 23. Here, the toner polarity controlling blade 16 is a conductive member configured to charge toner particles remaining on the photoconductor drum so as to have a single polarity when a predetermined voltage is applied from a power source (toner polarity controlling blade-power source) 27, and configured to scrape off at least part of the remaining toner particles. The cleaning brush roller 21 is a cleaning member configured to electrically adsorb toner particles present on the photoconductor drum when a predetermined voltage is applied from a power source (cleaning brush shaft voltage applying power source 30 and brush tip voltage applying power source 31). The recovering roller 23 is a first recovering member configured to electrically adsorb toner particles present on the cleaning brush roller 21 when a predetermined voltage is applied from a power source (recovering roller shaft voltage applying power source) 28. The recovering roller conductive cleaning blade 24 is a second recovering member configured to scrape off toner particles present on the recovering roller 23 when a predetermined voltage is applied from a power source (recovering roller conductive cleaning blade power source) 29.

The cleaning device 14 has a cleaning case, and opening sections of the cleaning case are provided with a cleaning inlet seal 17, a cleaning brush inlet seal 18 and a cleaning outlet seal 20, so that toner particles recovered from the photoconductor drum 1 does not leak outside the case. Also, a toner discharging screw 19 is disposed in a lower portion of the cleaning case. The toner discharging screw discharges recovered toner particles to, for example, an unillustrated waste toner container or returns them to the developing device.

Furthermore, the cleaning unit (device) 14 for the photoconductor drum has a quenching member (e.g., a quenching lamp) 26 which quenches a photoconductor drum 1 and is located downstream of the toner polarity controlling blade 16 but upstream of the cleaning brush roller 21 in a direction in which the photoconductor drum 1 is rotated.

In FIG. 1, reference numerals 15 and 25 denote a blade holder and a recovering roller blade holder, respectively.

Next will be described the operation of the image forming apparatus having the configuration shown in FIG. 1.

A series of image forming processes in this image forming apparatus include non-contact charging employing a non-contact charging roller 2, latent image formation, and N/P development (nega/posi development; i.e., toner particles adhere to a portion whose electrical potential is low).

In FIG. 1, when an unillustrated print button at an operation part is pressed, a predetermined voltage or current is sequentially applied at a predetermined timing to a non-contact charging roller 2, a developing roller 6, a transfer bias-applying roller 13 of the transfer device 10, a toner polarity controlling blade 16, a cleaning brush roller 21 and a recovering roller 23. Almost simultaneously with this, a photoconductor drum 1, the non-contact charging roller 2, a transfer belt 10A of the transfer device 10, the developing roller 6, a right developing screw 7, a left developing screw 8, a cleaning brush roller 21, a recovering roller 23 and a toner discharging screw 19 each begin to rotate in predetermined directions. For example, the photoconductor drum is rotated at a rotation speed of 205 mm/s and also, the cleaning brush roller 21 and the recovering roller 23 each are rotated at a rotation speed of 205 mm/s. The photoconductor drum 1 is uniformly negatively charged (−690 V) by the non-contact charging roller 2 disposed in a non-contact manner, and then exposed to laser light L emitted from an optical writing device 3, whereby a latent image is formed (electrical potential at a black solid portion: −120 V). The thus-formed latent image is developed with a magnetic brush formed on the developing roller 6 (developing bias: −550V) to form a toner image. In synchronization with formation of the toner image, a recording paper S is fed by an unillustrated paper feeding mechanism. A resist roller 9 temporarily holds the thus-fed recording paper so as to synchronize with the top end of the toner image, and then supplies it to between the photoconductor drum 1 and the transfer belt 10A, whereby the toner image is transferred onto the recording paper S (transfer bias applied: 30 μA). The recording paper S is separated from the photoconductor drum 1 by an unillustrated separating mechanism, and then is discharged through an unillustrated fixing device as a print (or copy) image.

Figure 2:
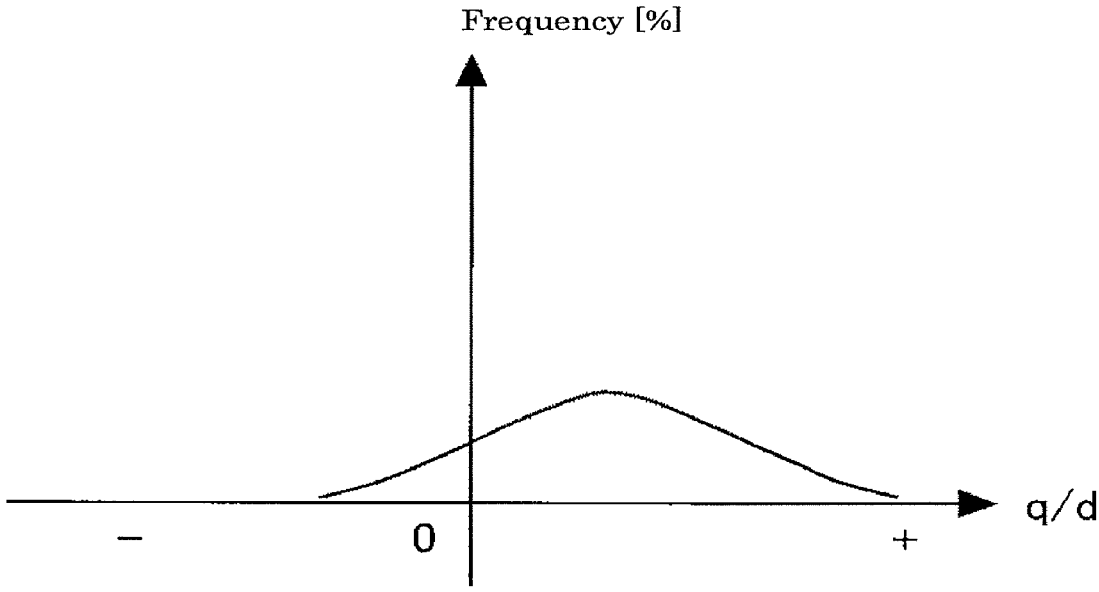
FIG. 2 is a graph of a q/d distribution of remaining toner particles after transfer.

Meanwhile, after the toner image has been transferred onto the recording paper S by the transfer device 10, toner particles remaining on the photoconductor drum 1 are a mixture of "positively charged" toner particles and "negatively charged" toner particles whose distribution is shown in FIG. 2. In accordance with rotation of the photoconductor drum 1, the remaining toner particles are conveyed to a contact portion between the photoconductor drum and the toner polarity controlling blade 16. The toner polarity controlling blade 16 mechanically scrapes off almost all the remaining toner particles. But, highly spherical toner particles, among them, tend to enter a nip portion between the toner polarity controlling blade 16 and the photoconductor drum 1 to run through the contact portion therebetween. Here, the toner polarity controlling blade 16 has the same polarity as the toner particles (negative polarity) by applying a voltage thereto using the toner polarity controlling blade power source 27 and thus, negatively charges the toner particles running through the contact portion between the toner polarity controlling blade 16 and the photoconductor drum 1, whereby the toner particles are regularly charged. In accordance with rotation of the photoconductor drum 1, the toner particles regularly charged by the toner polarity controlling blade 16 are conveyed to a position of the photoconductor drum 1 at which the cleaning brush roller 21 is disposed. The shaft of the cleaning brush roller 21 has positive polarity by applying a voltage thereto using the cleaning brush shaft voltage applying power source 30, and the brush tips thereof have positive polarity by applying a voltage thereto using the brush tip voltage applying power source 31 via a brush tip voltage applying electrode rod 22. Thus, the cleaning brush roller 21 electrostatically adsorbs the regularly charged toner particles. The adsorbed toner particles on the cleaning brush roller 21 are moved by an electric potential gradient to a recovering roller 23 which has higher positive polarity than the cleaning brush roller 21 by applying a higher voltage thereto using a recovering roller shaft voltage applying power source 28. Subsequently, the toner particles moved on the recovering roller 23 are scraped off by a recovering roller conductive cleaning blade 24, which is disposed so as to contact the recovering roller 23 and is given a predetermined voltage from a recovering roller conductive cleaning blade power source 29. Thereafter, the scraped toner particles are discharged outside the apparatus by the toner discharge screw 19 or are returned to the developing device 4.

Next will be described the polarity controlling function of the cleaning device 14.

Figure 3:
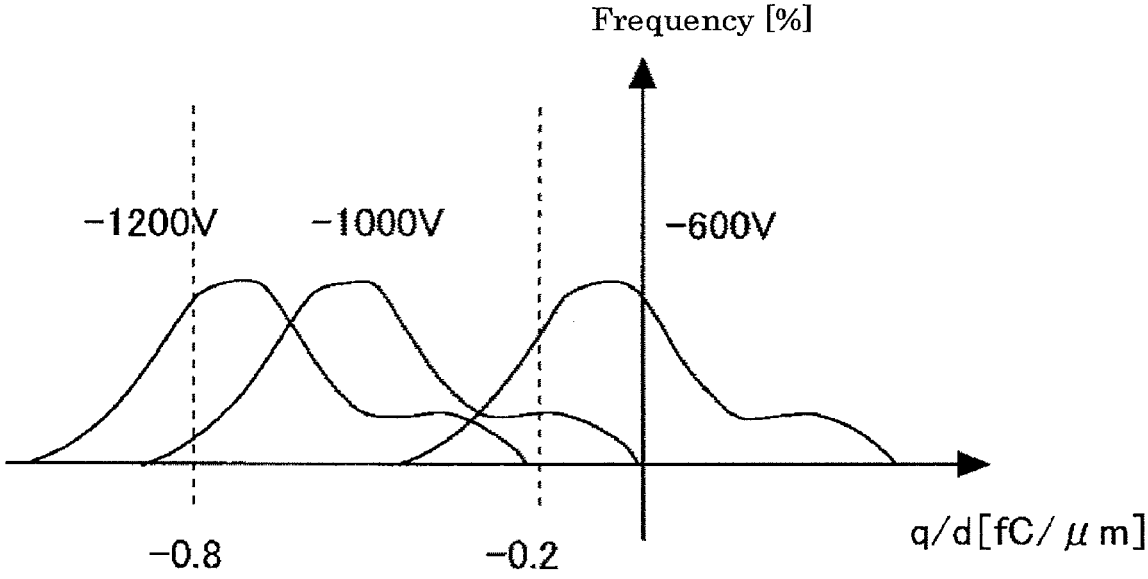
FIG. 3 is a graph of control voltages of a toner polarity controlling blade vs. q/d distributions of toner particles having undergone polarity control.
Figure 4A:
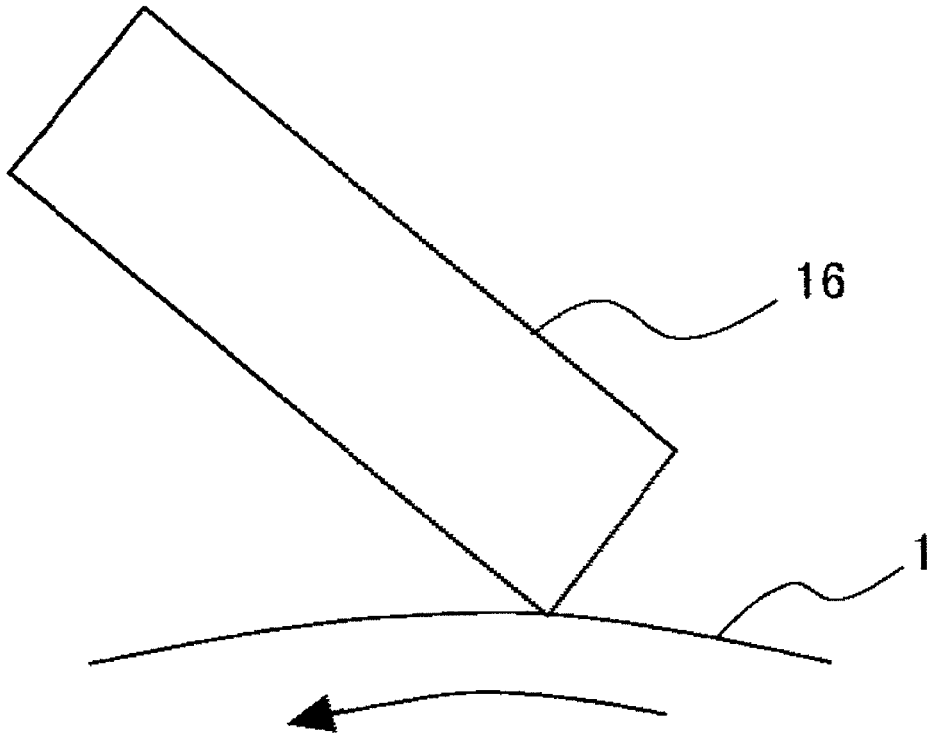
FIG. 4A illustrates a photoconductor drum and a toner polarity controlling blade which are in contact with each other.
Figure 4B:
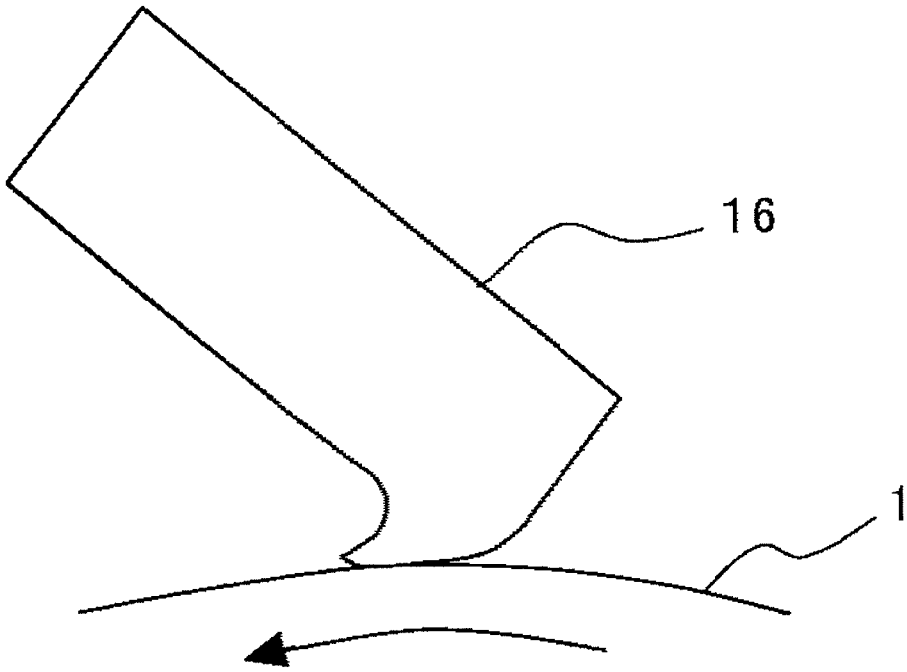
FIG. 4B illustrates a photoconductor drum and a toner polarity controlling blade warped thereon.

First will be described a mechanism in which toner particles change in polarity when they run through a contact portion between a photoconductor and a toner polarity controlling blade 16 which is charged to have the same polarity as the regularly charged toner particles. FIG. 3 shows a relationship between the intensities of voltage applied to the toner polarity controlling blade (polarity BL) 16 and q/d distributions after controlling. As shown in FIG. 3, toner particles running through the contact portion between the photoconductor and the toner polarity controlling blade 16 change in polarity to have regular polarity with increasing of the difference in electrical potential between the photoconductor surface and the toner polarity controlling blade 16. This electrical potential is caused by, for example, "friction charging," "charge injection," and "discharge" occurring between the photoconductor drum 1 and the toner polarity controlling blade 16. As shown in FIGS. 4A and 4B, the edge of the toner polarity controlling blade 16 is warped in a direction in which the photoconductor drum 1 is rotated; i.e., a stick slip phenomenon occurs. When the toner polarity controlling blade 16 is in a state shown in FIG. 4B, toner particles are likely to run through the contact portion. And, when the toner particles are pressed between the toner polarity controlling blade 16 and the photoconductor drum 1, an electric current is applied to them from the toner polarity controlling blade 16 to which a voltage has been applied. In this manner, before passing the toner polarity controlling blade 16, the toner particles are charged to have the same polarity as the blade. Supposedly, change in polarity of the toner particles in this state is caused as a result of charge injection. Also, when the difference in electrical potential between the surface electrical potential of the photoconductor drum 1 and the voltage applied to the toner polarity controlling blade 16 is a value falling within a range in which discharge occurs, discharge occurs in micro gaps at wedge-shaped inlet and outlet portions each being defined by the photoconductor drum 1 and the toner polarity controlling blade 16, whereby the toner particles are charged to have the same polarity as the blade. The wedge-shaped inlet portion is stained by toner particles since it mechanically scrapes off the tone particles. Thus, discharge in the micro gap occurs mainly at the wedge-shaped outlet portion. Also, the toner polarity controlling blade 16 is coated at its contact portion with a conductive acrylic resin. This resin coating decreases the friction coefficient between the photoconductor and the blade and thus, a stick slip phenomenon is difficult to occur, whereby the micro gaps are maintained. Furthermore, such a resin-coated blade becomes more resistant to ablation and can exhibit its functions for a long period of time.

Next will be described the cleaning function of the cleaning device 14.

Figure 5:
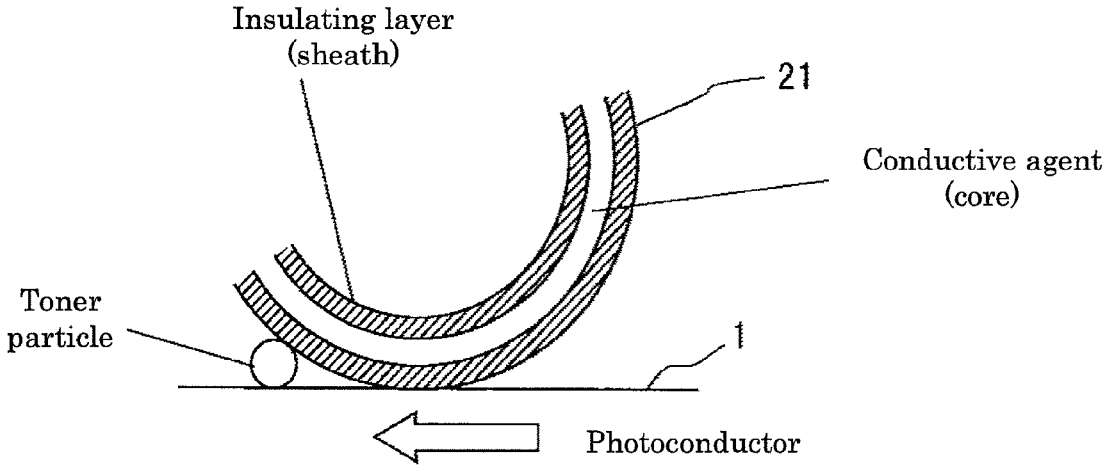
FIG. 5 is a sketch in which a toner particle is in contact with a curled tip portion of a fiber of a brush roller.

First will be described in detail the configuration of an electrostatic cleaning part. Since charges are prevented from injecting toner particles between the photoconductor drum 1 and the cleaning brush roller 21, the cleaning brush roller 21 is composed of core-in-sheath fibers as shown in FIG. 5, each of the fibers being inclined downstream in a direction in which the brush roller 21 is rotated. When the cleaning brush roller 21 is disposed so that each fiber is curled as shown in FIG. 5, a cut surface of the fiber, where a conductive portion is exposed, is prevented from contacting with toner particles to the greatest extent possible, preventing charge injection into toner particles. Also, a recovering roller 23 is formed from a metal core, a PVDF tube wound around the core, and a surface insulating layer provided on the tube, in order that charges are prevented from injecting toner particles between the cleaning brush roller 21 and the recovering roller 23. Furthermore, a brush roller metallic charging member (e.g., a brush tip voltage applying electrode rod) 22, which has the same electrical potential as the shaft of the cleaning brush roller 21, is disposed so as to contact the tip surface of the brush of the cleaning brush roller 21. The reason why the brush tip voltage applying electrode rod is provided lies in that charges must be supplied to brush fibers since their insulating surfaces are decreased in electrical potential after toner particles have been moved from the cleaning brush roller 21 to the recovering roller 23. Hitherto, the reason why the brush is decreased in surface electrical potential has not been unclear, but this has been thought to occur as a result of giving and receiving toner particles. At present, one possible reason is that the insulating brush surface is negatively charged through separating discharge occurring when charged toner particles adhering thereto are moved to the recovering roller 23. Another possible reason is that toner particles negatively charge surface layers of fibers during adhering thereto, and negative charges remain after the toner particles have been moved therefrom. When decreased in electrical potential, the cleaning brush roller 21 exhibits a decreased property of removing toner particles from the photoconductor drum 1. In view of this, the brush roller metallic charging member (e.g., a brush tip voltage applying electrode rod) 22, which is given a voltage having the same intensity as that applied to the cleaning brush roller 21, is provided as a member for compensating decrease in electrical potential on the fiber surfaces.

Similar to the case of the cleaning brush roller 21, the recovering roller 23 is also decreased in surface electrical potential after toner particles thereon are scraped off with a recovering roller conductive cleaning blade 24. The reason for this is still unclear, but one possible reason is that a high-resistance layer or an insulating layer is negatively charged through separating discharge occurring when charged toner particles adhering to a surface of the recovering roller 23 are scraped off with the recovering roller conductive cleaning blade 24. Another possible reason is that toner particles negatively charge a surface layer of the recovering roller 23 during adhering thereto, and negative charges remain after the toner particles have been scraped off with the recovering roller conductive cleaning blade 24. For this reason, similar to the case of the cleaning brush roller 21, the recovering roller conductive cleaning blade 24, which is in contact with the surface of the recovering roller 23, is also given a voltage higher than that applied to the shaft of the recovering roller 23.

Toner particles on the recovering roller 23 are mechanically scraped off with the recovering roller conductive cleaning blade 24. Next will be described that even spherical toner particles can be removed from the recovering roller 23.

First of all, unlike the case of the photoconductor drum 1, the recovering roller 23 can be made of any materials, so long as it has the function of transferring toner particles adhering to the cleaning brush roller 21 to the recovering roller 23 by an electric potential gradient between the cleaning brush roller 21 and the recovering roller 23. Thus, when a surface of the recovering roller 23 is coated with a material having low friction coefficient or the recovering roller 23 is formed by winding, around a metal roller, a tube having low friction coefficient, even spherical toner particles can be readily removed therefrom. Specifically, the recovering roller 23 is formed by subjecting a metal roller to fluorine coating, or by winding a PVDF or PFA tube around a metal roller.

Next will be given various information regarding constituent members of the cleaning device 14.

[Toner Polarity Controlling Blade 16]

Material for toner polarity controlling blade: dispersion of ion-conducting agent and carbon conducting agent in polyurethane (conductive acrylic coat having a thickness of 5 μm is formed on surface)

Intrusion amount of toner polarity controlling blade with respect to photoconductor drum: 1 mm Contact angle of toner polarity controlling blade with photoconductor drum: 20°

Thickness of toner polarity controlling blade: 2 mm

Free length of toner polarity controlling blade: 7 mm

Hardness of toner polarity controlling blade: 60 to 80 (JIS A hardness meter)

Rebound resilience of toner polarity controlling blade: 30%

Electrical resistance of toner polarity controlling blade: 106 g·cm to $10^8$ Ω·cm Control voltage for toner polarity controlling blade (constant voltage control): −1,200 V

[Cleaning Brush Roller 21]

Material of brush roller: conductive polyester

Diameter of brush roller: 14 mm

Fiber length of brush roller: 4 mm

Intrusion amount of brush roller with respect to photoconductor drum: 1 mm

Linear velocity of brush roller: 205 mm/s (equal to that of photoconductor drum)

Voltage applied to brush roller charge imparting member (electrode rod 22): 100 V Voltage applied to shaft of brush roller: 100 V Electrical resistance of original yarn of brush roller: $10^8$ Ω·cm Fiber density of brush roller: 100,000/inch$^2$ (1 inch=0.0254 m)

Arrangement of fibers of brush roller: inclined downstream in a direction in which the brush roller is rotated

[Recovering Roller 23]

Material for recovering roller: SUS core metal, PVDF tube (100 μm) wound therearound, insulating acrylic surface layer (5 μm)

Diameter of recovering roller: 12 mm

Linear velocity of recovering roller: 205 mm/s

Voltage applied to shaft of recovering roller: 500 V

[Recovering Roller Conductive Cleaning Blade 24]

Material for recovering roller conductive cleaning blade: dispersion of ion-conducting agent and carbon conducting agent in polyurethane (conductive acrylic coat having a thickness of 5 μm is formed on surface)

Intrusion amount of recovering roller conductive cleaning blade with respect to recovering roller: 1 mm Contact angle of recovering roller conductive cleaning blade with recovering roller: 200

Thickness of recovering roller conductive cleaning blade: 2 mm

Free length of recovering roller conductive cleaning blade: 7 mm

Hardness of recovering roller conductive cleaning blade: 60 to 80 (JIS A hardness meter)

Rebound resilience of recovering roller conductive cleaning blade: 30%

Electrical resistance of recovering roller conductive cleaning blade: $10^6$ Ω·cm to $10^8$ Ω·cm Voltage applied to recovering roller conductive cleaning blade: 500 V Similar to the above-described cleaning device 14 for the photoconductor drum, the transfer device 10 is also provided with a transfer belt cleaning device 32 which removes/recovers powder (e.g., toner particles and paper dust) adhering to the belt surface after conveyance of a recording medium. The transfer belt cleaning device 32 may have the same configuration as the cleaning device 14. Also, in this case, no quenching member is required.

EXAMPLES

Next will be described an exemplary image forming apparatus to which the cleaning device 14 having the above-described configuration is mounted, together with its problems and measures against them.

Example 1

Problem 1 and Measure Against it

Figure 6:
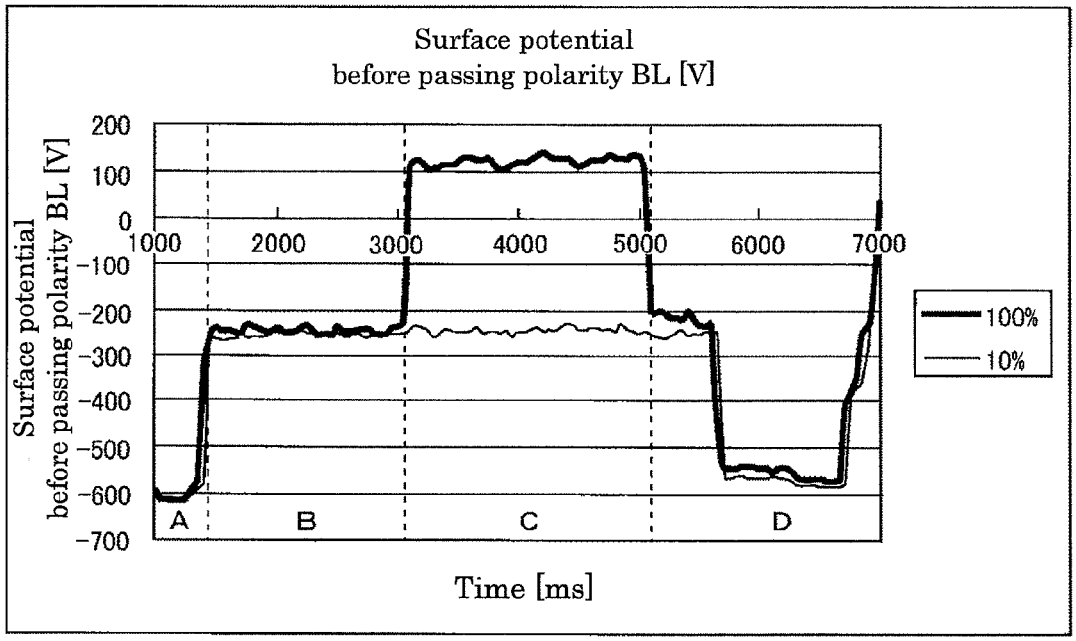
FIG. 6 is a graph of a change in electrical surface potential of a portion of a photoconductor, the portion being a portion which has not passed a toner polarity controlling blade (before passing a polarity BL), wherein the graph is obtained when one A3 size image is printed out.
Figure 7:
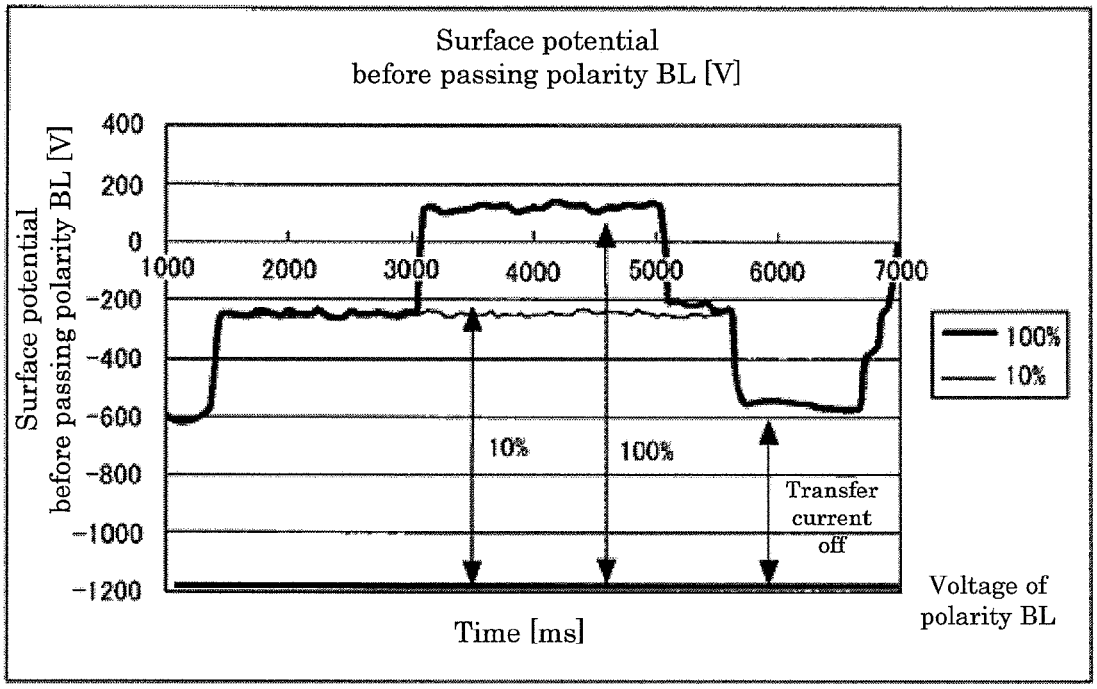
FIG. 7 is a graph of a change in electrical potential between a polarity BL and a photoconductor surface which has not passed a toner polarity controlling blade (before passing a polarity BL).
Figure 8:
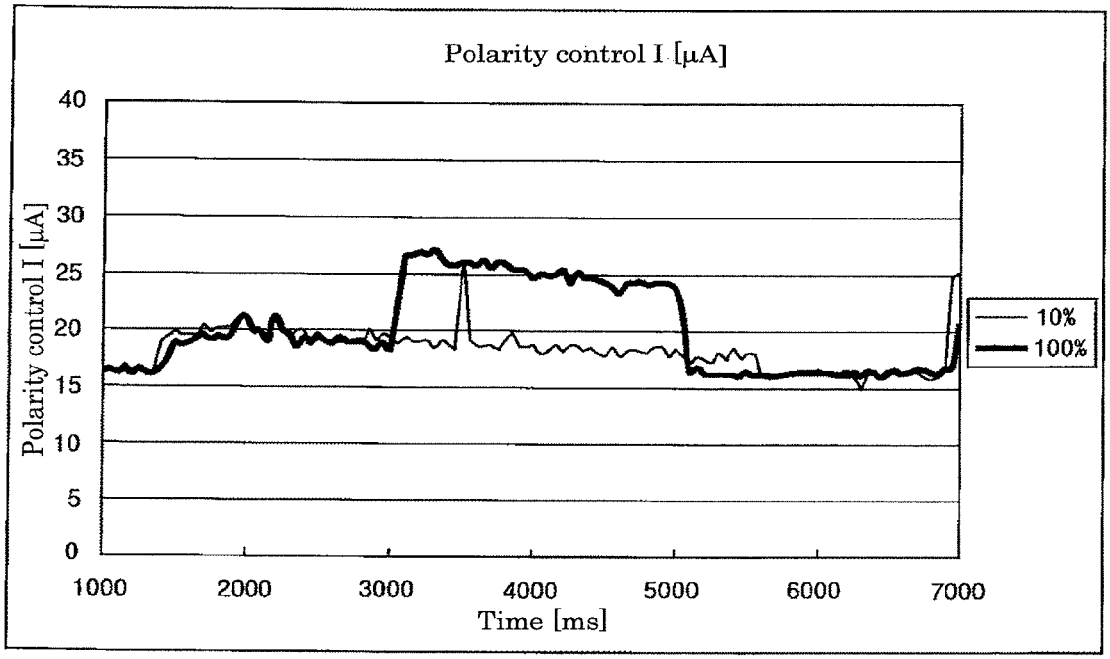
FIG. 8 is a graph of a change of a current value (polarity control I) of a toner polarity controlling blade, the graph being obtained when one A3 size image is printed out.

The cleaning device 14 having the above-described configuration was mounted as a photoconductor cleaning unit to an image forming apparatus shown in FIG. 1. The image forming apparatus was caused to print an A3 size image on one sheet. FIG. 6 is a graph relating to the surface potential of a portion of the photoconductor after printing, the portion being a portion which has not passed the toner polarity controlling blade 16 (before passing a polarity BL). In FIG. 6, a charging roller power source 2 is on in areas A and D, the charging roller power source 2 and a bias-applying power source for a transfer device 10 are on in areas B and C, and an image is formed in area C. Here, a thick line corresponds to a change in surface potential of the photoconductor having undergone printing, on one sheet, an image with an image area ratio of 100%, while a thin line corresponds to a change in surface potential of the photoconductor having undergone printing, on one sheet, an image with an image area ratio of 10%. When the toner polarity controlling blade 16 is controlled at a constant voltage of −1,200 V, as shown in FIG. 7, the difference in electrical potential between the photoconductor surface and the toner polarity controlling blade 16 undesirably varies depending on the image area ratio of the image printed and on whether a transfer electric current is on or off. In addition, the electric current value of the toner polarity controlling blade 16 also changes with a change in photoconductor surface potential as shown in FIG. 8. In this configuration, when a transfer electric current is off, the sufficient difference in electrical potential (about −600 V) is not obtained, resulting in failure to control polarity so as to attain an optimal q/d distribution; i.e., resulting in insufficient polarity control as shown in FIG. 3. In this state, when toner particles or other materials remaining on the edge portion of the toner polarity controlling blade 16 run through the contact portion between the photoconductor and the blade, sufficient cleaning cannot be performed, leading to cleaning failure.

Figure 9:
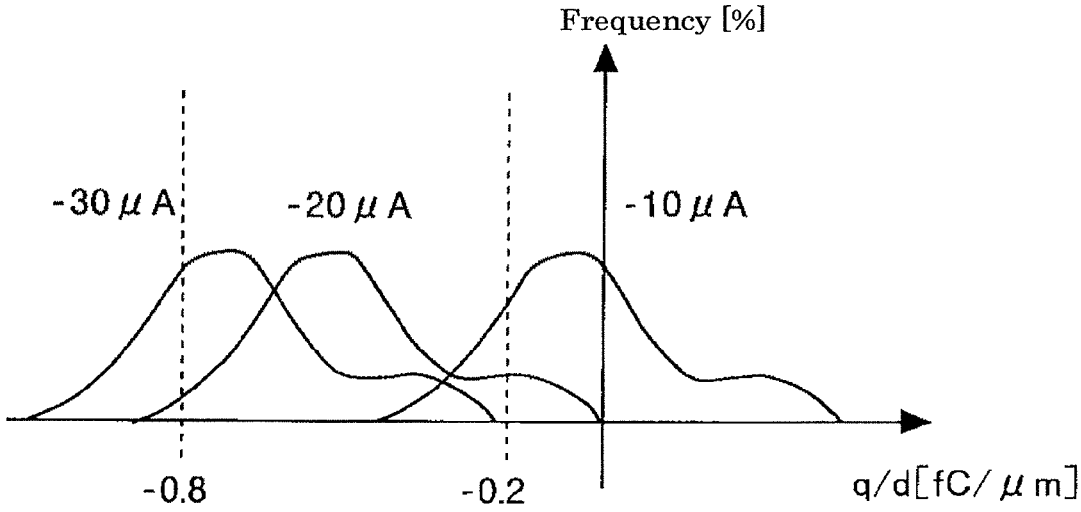
FIG. 9 is a graph of control currents of a toner polarity controlling blade vs. q/d distributions of toner particles having undergone polarity control.
Figure 10:
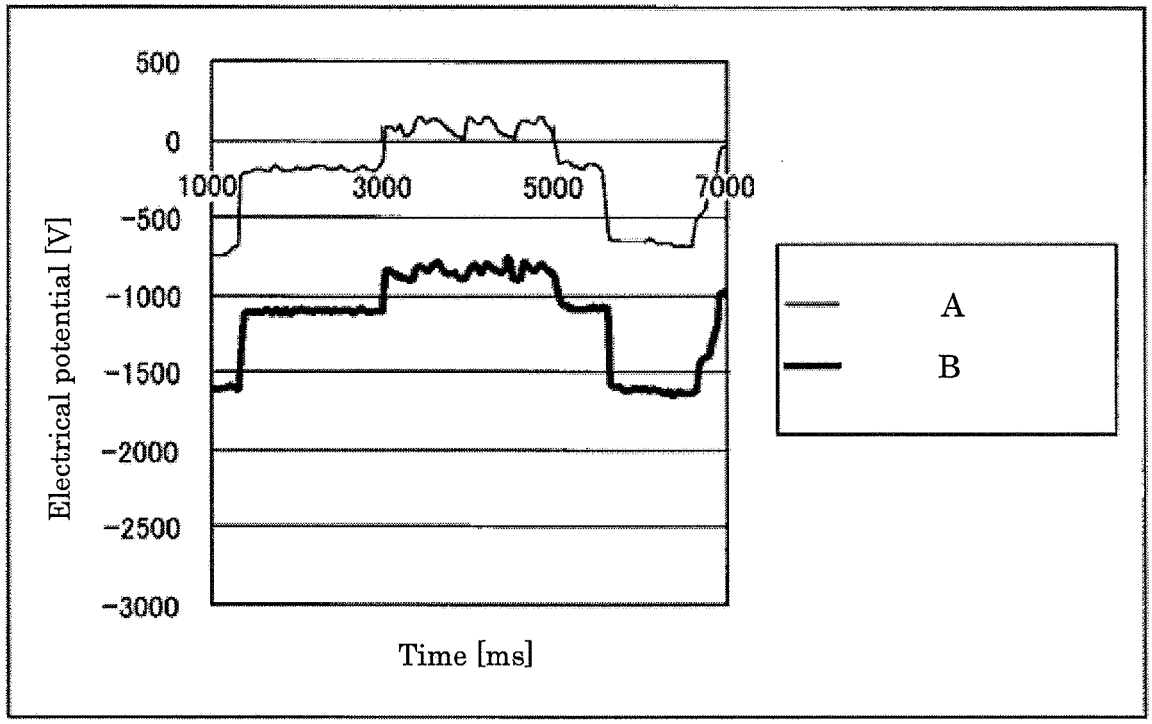
FIG. 10 is a graph showing a change in electrical surface potential of a portion of a photoconductor, the portion being a portion which has not passed a toner polarity controlling blade (polarity BL) constant-current controlled (indicated by curve A) and a change in voltage of the polarity BL (indicated by curve B).

In the present invention, as a measure against the above problem, the toner polarity controlling blade 16 is constant-current controlled. Also in this case, similar to the case of constant voltage control, polarity controlling performance increases with increasing of the electric current value, so that the q/d distribution shifts toward a more negative range as shown in FIG. 9. For example, when the toner polarity controlling blade 16 is given a voltage through constant current control at −20 μA, the voltage of the toner polarity controlling blade 16 changes, as shown in FIG. 10, depending on a change in surface potential of the photoconductor. In this manner, in the above areas A to D, the difference in electrical potential is maintained constant between the photoconductor surface and the toner polarity controlling blade 16. As a result, the cleaning device was able to stably exhibit desired polarity controlling performance and thus, to stably exhibit desired cleaning performance.

Problem 2 and Measure Against it

Figure 11:
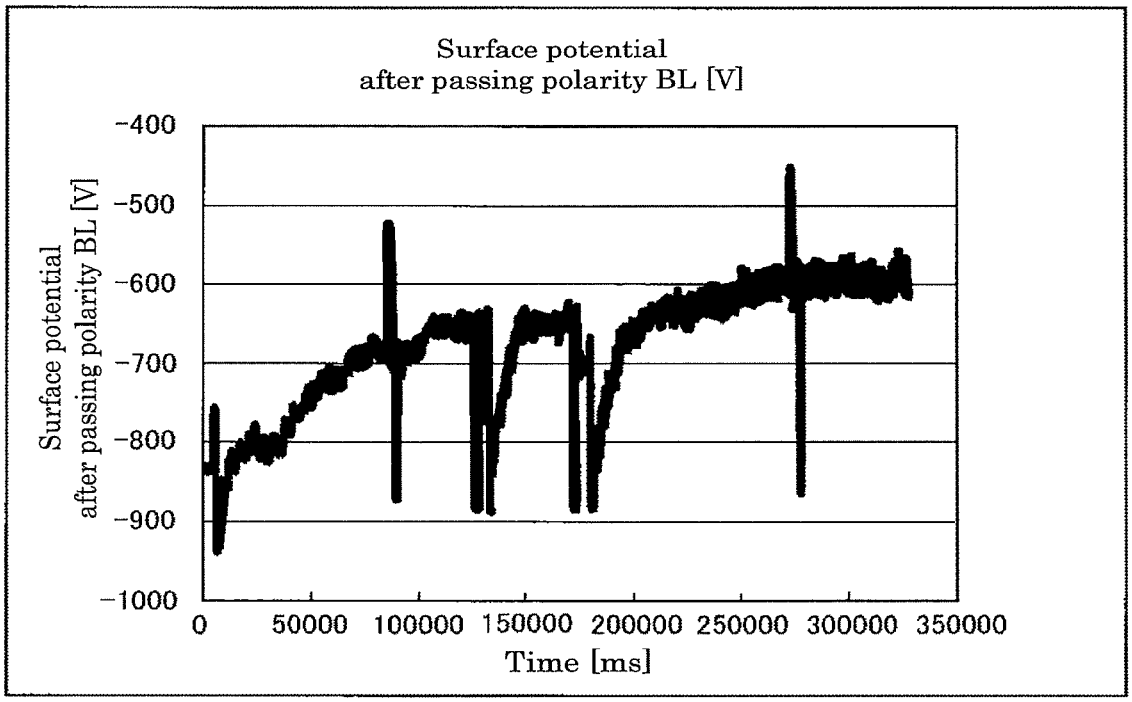
FIG. 11 is a graph of a change over time in surface potential of a portion of a photoconductor, the portion being a portion which has passed a toner polarity controlling blade (after passing a polarity BL).
Figure 12:
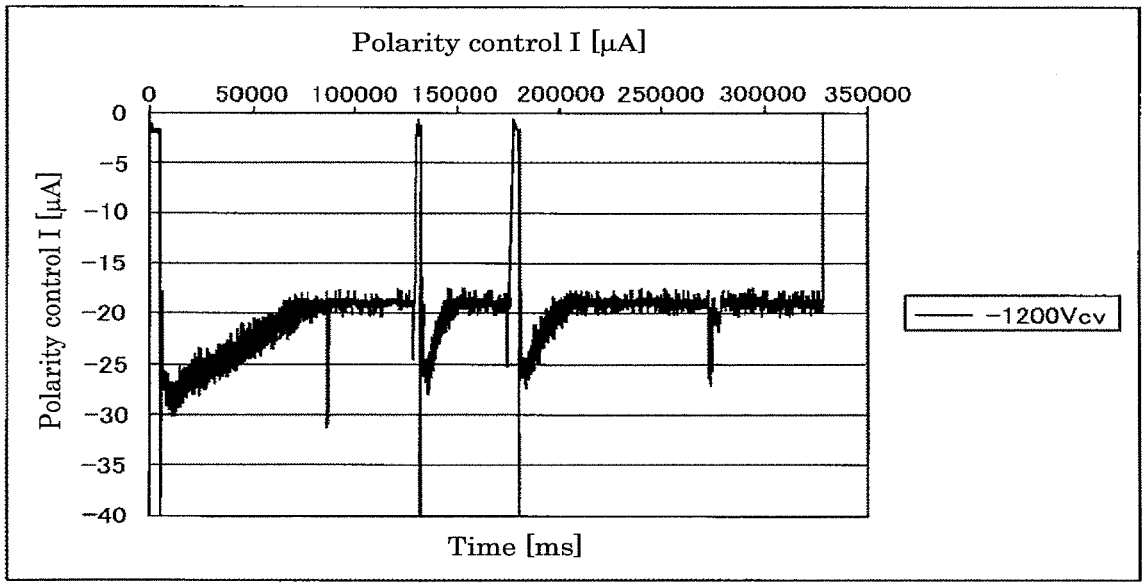
FIG. 12 is a graph of a change over time in current (polarity control I) of a toner polarity controlling blade.
Figure 13:
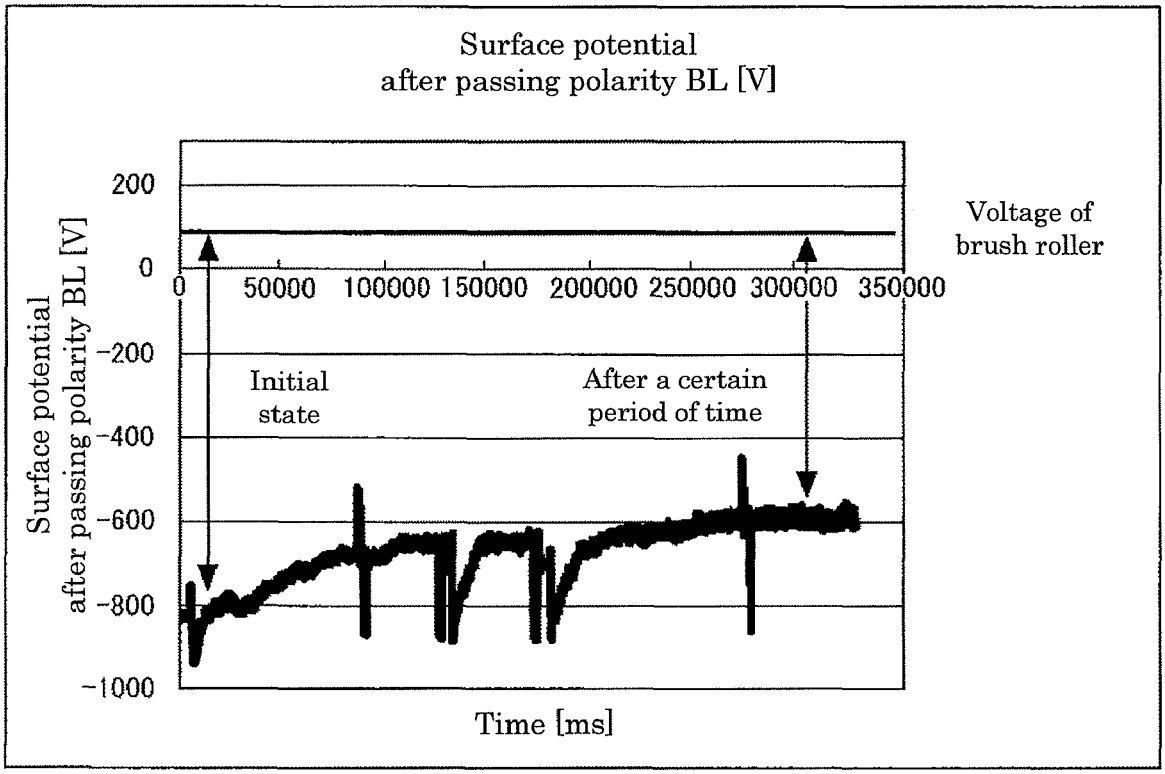
FIG. 13 is a graph of a change over time in electrical potential between a brush roller and a photoconductor surface which has passed a toner polarity controlling blade (polarity BL).

The image forming apparatus was caused to print an A4 size image having an image area ratio of 5% on 200 sheets with the toner polarity controlling blade 16 was being constant-voltage controlled at −1,200 V. As shown in FIG. 11, there was gradually increased the surface potential of a portion of the photoconductor after printing, the portion being a portion which has passed the toner polarity controlling blade 16 (after passing a polarity BL). Also, as shown in FIG. 12, the current value (polarity control I) of the toner polarity controlling blade 16 was gradually decreased. Meanwhile, the constant voltage is applied to the cleaning brush roller 21 disposed downstream in a direction in which the photoconductor is rotated. As a result, as shown in FIG. 13, the difference in electrical potential undesirably changes between the photoconductor surface and the brush roller 21, leading to a drop in cleaning performance. The surface potential of the photoconductor increases over time due to a decrease in electric value of the toner polarity controlling blade 16. The decrease of the electric value is caused by increase in electrical resistance of the toner polarity controlling blade 16, which occurs as a result of toner adhesion to the toner polarity controlling blade 16 and/or change in physical properties of the conductive rubber member and the conductive tape. When the toner polarity controlling blade 16 was controlled at a constant voltage of −1,200 V, the current value was decreased from −30 μA to about −20 μA (as an absolute value).

Figure 14:
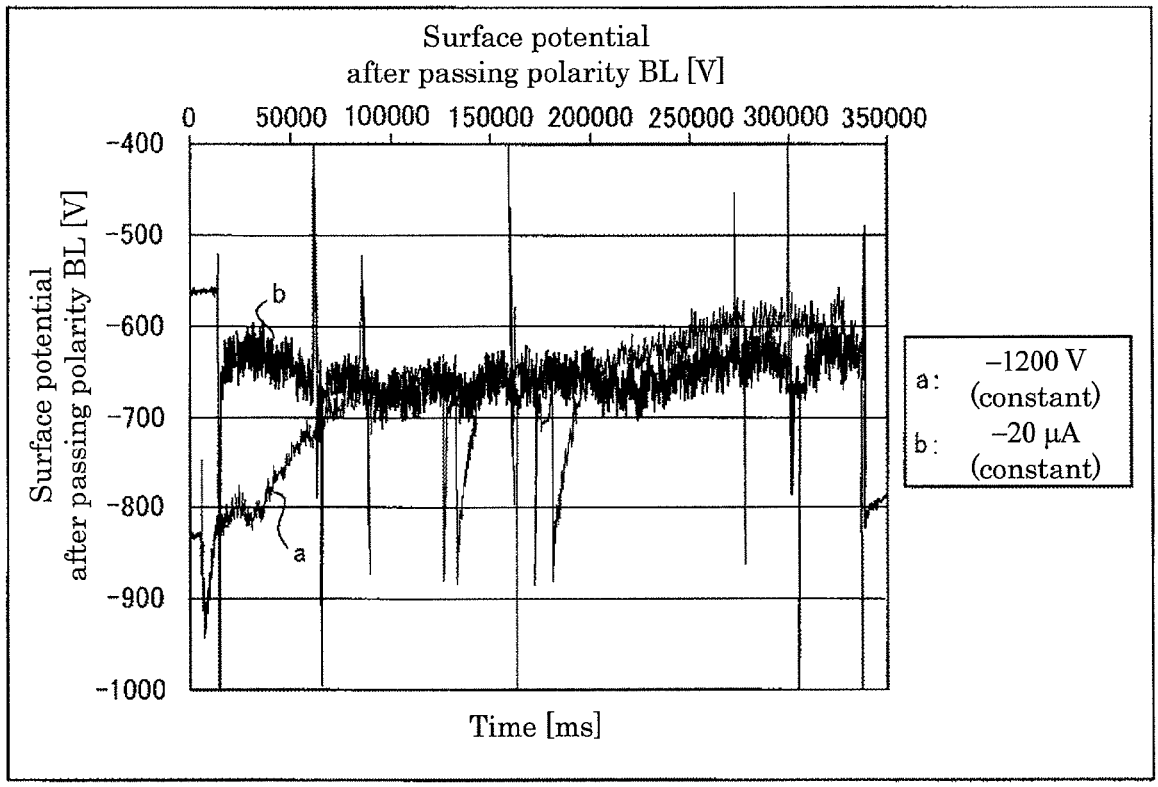
FIG. 14 is a graph of a change over time in surface potential of a portion of a photoconductor, the portion being a portion which has passed a toner polarity controlling blade (polarity BL) constant-current controlled.

In the present invention, as a measure against the above problem, for example, the toner polarity controlling blade 16 is given a voltage through constant current control at −20 μA. As is clear from a curve indicated by "b" in FIG. 14, there could be constantly stabilized the surface potential of a portion of the photoconductor, the portion being a portion which has passed the toner polarity controlling blade 16. As a result, even when the constant voltage was applied to the cleaning brush roller 21, the cleaning device was able to stably exhibit desired cleaning performance. In this case, since the resistance value increases and the current value is constant, the voltage value of the toner polarity controlling blade 16 increases over time. Although this affects the polarity controlling performance of the blade, such a problem does not arise that cleaning cannot be performed due to insufficient polarity control, even if the blade is somewhat excessively charged. This is because, in accordance with increasing of the voltage value of the toner polarity controlling blade 16, the difference in electric potential becomes greater between the photoconductor surface and the toner polarity controlling blade 16.

Problem 3 and Measure Against it

As described above in relation to problem 2, when the toner polarity controlling blade 16 is used for a certain period, its electrical resistance value increases and its current value decreases, as a result of toner adhesion thereto and/or change in physical properties of the conductive rubber member and the conductive tape. In this state, as compared with the initial state, charge injection into toner particles and discharge in micro gaps are difficult to occur, leading to decrease in polarity controlling performance thereof.

In the present invention, as a measure against this problem, for example, the toner polarity controlling blade 16 is given a voltage through constant current control at −20 μA. As a result, even when the resistant value of the toner polarity controlling blade 16 fluctuates, charge injection and discharge were able to be made to occur stably. Then, the blade was able to stably exhibit its cleaning performance, since its polarity controlling performance was desirably maintained over time.

Example 2

Figure 15:
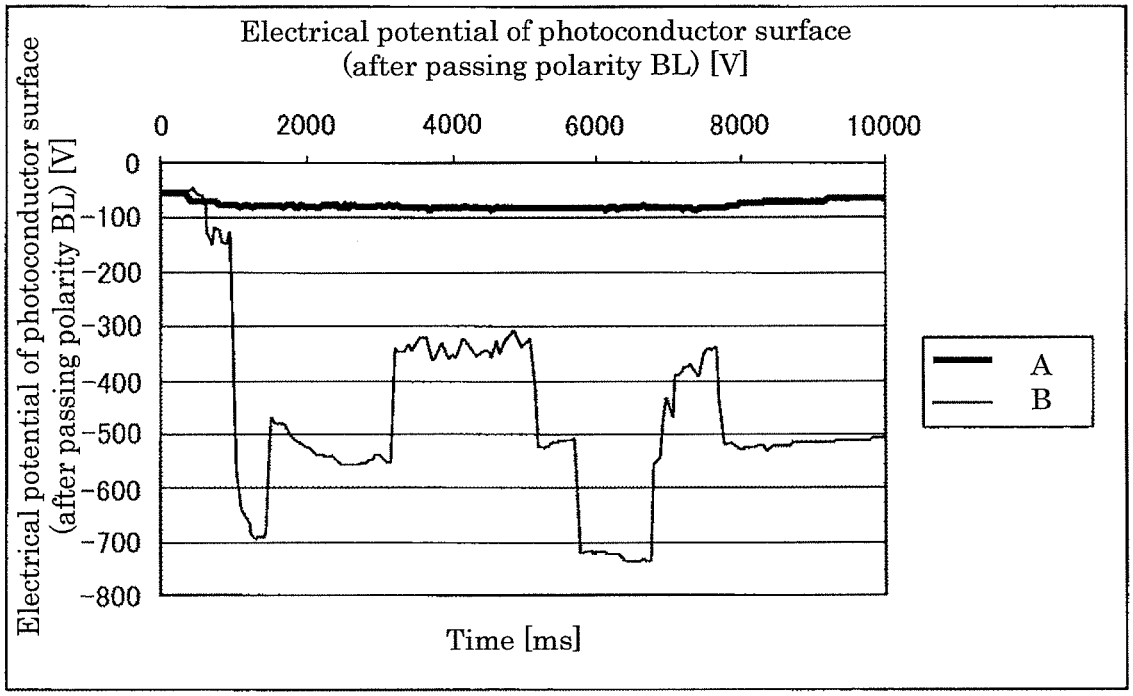
FIG. 15 is a graph of a change in surface potential of a portion of a photoconductor, the portion being a portion which has passed a toner polarity controlling blade (polarity BL), wherein the graph is for comparing the case where a quenching lamp (QL) is operated with the case where a quenching lamp (QL) is not operated, the change in the former case being indicated by curve A and that in the latter case being indicated by curve B.
Figure 16:
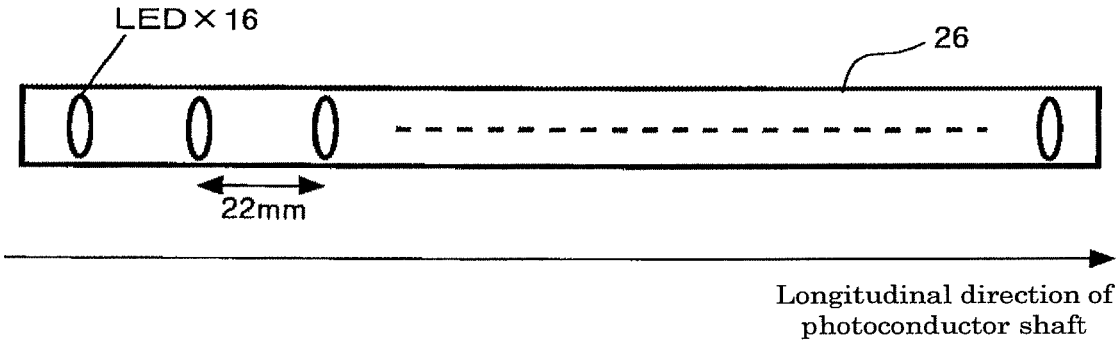
FIG. 16 illustrates an exemplary configuration of a quenching lamp.

As described in Example 1, when the toner polarity controlling blade 16 is given a voltage through constant current control, the voltage of the toner polarity controlling blade 16 (polarity BL voltage) changes, as shown in FIG. 10, depending on a change in surface potential of the photoconductor (surface potential before passing a polarity BL). Thus, in areas A to D, the difference in electrical potential can be maintained constant between the photoconductor surface and the toner polarity controlling blade 16, enabling its polarity controlling performance to be stable. Here, the toner polarity controlling blade 16 is constantly given a negative voltage. Thus, there is constantly negative the electrical potential of a portion of the photoconductor, the portion being a portion which has passed the toner polarity controlling blade 16. As shown in FIG. 1, when a quenching member (e.g., a quenching lamp (QL)) 26 is provided between the toner polarity controlling blade 16 and the cleaning brush roller 21, there is constantly about 0 the electrical potential of a portion of the photoconductor, the portion being a portion which has passed the toner polarity controlling blade 16 (after passing a polarity BL) (see FIG. 15). Thus, when the cleaning brush roller 21 is given a voltage at which the optimal difference in electrical potential is obtained between the photoconductor surface and the cleaning brush roller 21 (i.e., 600 V in this Example), the difference in electrical potential could be constantly maintained optimal therebetween, whereby the cleaning device could stably exhibit its cleaning performance. Notably, the quenching lamp (QL) 26 used had 16 light emitting diodes (LEDs) disposed at 22 mm intervals in a longitudinal direction of the shaft of the photoconductor (see FIG. 16).

Example 3

Next will be described a photoconductor serving as an image bearing member of the image forming apparatus of the present invention.

An image bearing member used in the image forming apparatus of the present invention may be an amorphous silicon photoconductor.

Regarding Amorphous Silicon Photoconductor

The electrophotographic photoconductor used in the present invention may be an amorphous silicon photoconductor (hereinafter may be referred to as an "a-Si photoconductor") having a conductive support and a photoconductive layer made of amorphous silicon (a-Si). The amorphous silicon photoconductor is produced by forming, on the conductive support heated at 50° C. to 400° C., the photoconductive layer through film formation such as vacuum vapor deposition, sputtering, ion plating, thermal CVD, photo-CVD or plasma CVD. Of these, preferably used is plasma CVD in which raw material gas is decomposed through DC, high-frequency or microwave glow discharge to form an a-Si deposition film on the support.

Regarding Layer Structure

The layer structure of the amorphous silicon photoconductor is, for example, that described below. FIGS. 17A to 17D are explanatory, schematic views of the layer structure. An electrophotographic photoconductor 500 shown in FIG. 17A has a support 501 and a photoconductive layer 502 made of a-Si:H,X (where H denotes a hydrogen atom and X denotes a halogen atom (F, Cl, Br or I)), the photoconductive layer being laid on the support. An electrophotographic photoconductor 500 shown in FIG. 17B has a support 501, a photoconductive layer 502 made of a-Si:H,X, and an amorphous silicon-based surface layer 503, these layers being laid on the support. An electrophotographic photoconductor 500 shown in FIG. 17C has a support 501, a photoconductive layer 502 made of a-Si:H,X, an amorphous silicon-based surface layer 503, and an amorphous silicon-based charge injection preventing layer 504, these layers being laid on the support. An electrophotographic photoconductor 500 shown in FIG. 17D has a support 501, a photoconductive layer 502 (a charge generation layer 505 made of a-Si:H,X+a charge transport layer 506 made of a-Si:H,X) and an amorphous silicon-based surface layer 503, the photoconductive layer and the amorphous silicon-based surface layer being laid on the support in this order.

Regarding Support

The support 501 of the photoconductor 500 may be conductive or electrically insulative. The conductive support is made, for example, of a metal such as Al, Cr, Mo, Au, In, Nb, Te, V, Ti, Pt, Pd or Fe; and an alloy thereof (e.g., stainless steel). Also, there may be used an electrically insulating support (e.g., glass, ceramic and films or sheets of synthetic resin such as polyester, polyethylene, polycarbonate, cellulose acetate, polypropylene, polyvinyl chloride, polystyrene or polyamide) in which at least a surface on which a conductive layer is to be laid has been subjected to a conductive treatment. The support may be a cylindrical, plate-like or endless belt support having a smooth or surface or irregular surface. The thickness of the support is appropriately determined so that an intended image forming apparatus photoconductor can be formed. When the image forming apparatus photoconductor is required to have flexibility, the support may be thin to the greatest extent possible so long as it can sufficiently exhibit its intrinsic functions. However, the thickness of the support is generally 10 μm or greater from the viewpoints of, for example, production suitability, handleability and mechanical strength.

Regarding Charge Injection Preventing Layer

Figure 17A:
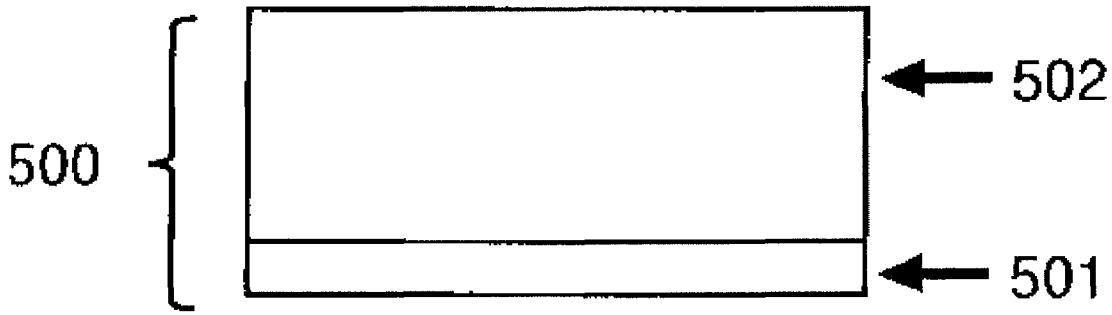
FIG. 17A is a cross-sectional view of a layer structure of an amorphous silicon photoconductor.
Figure 17B:
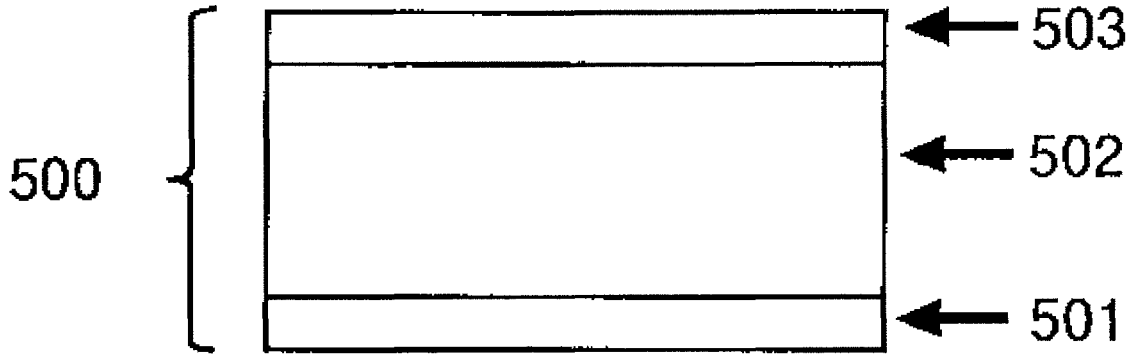
FIG. 17B is a cross-sectional view of another layer structure of an amorphous silicon photoconductor.
Figure 17C:
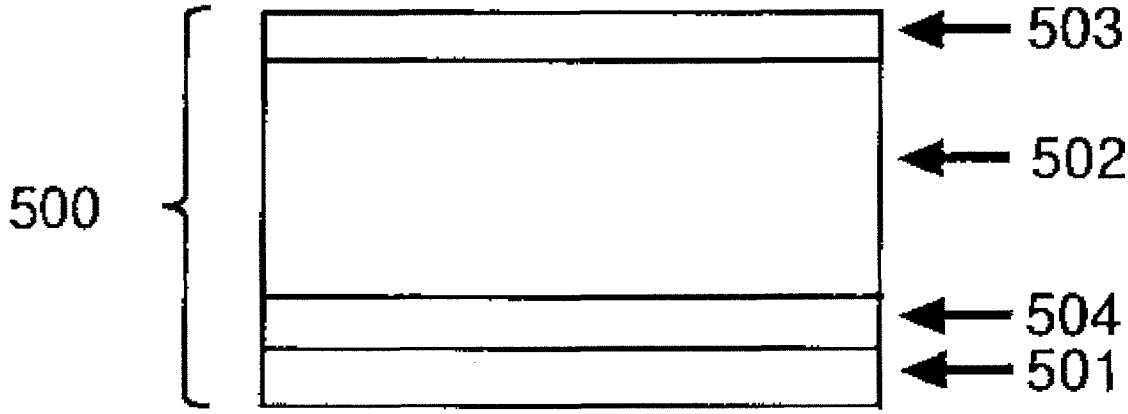
FIG. 17C is a cross-sectional view of still another layer structure of an amorphous silicon photoconductor.
Figure 17D:
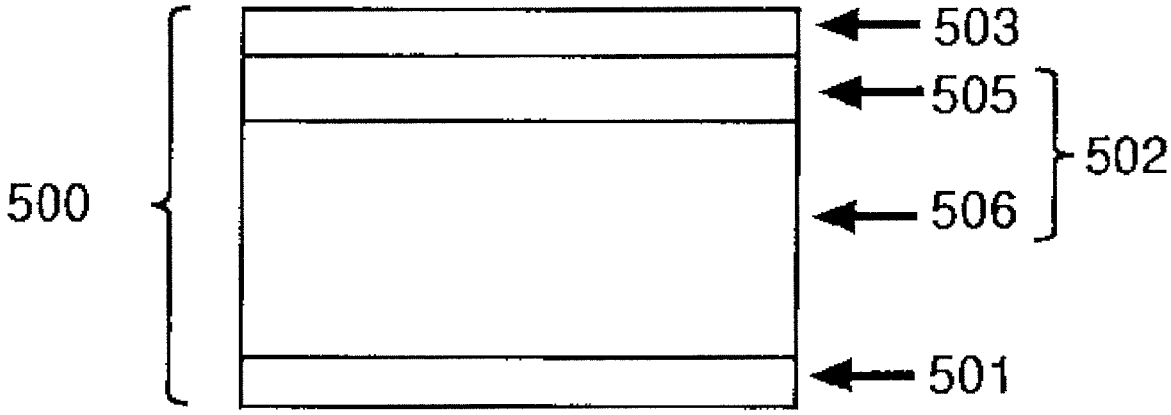
FIG. 17D is a cross-sectional view of yet another layer structure of an amorphous silicon photoconductor.

In the amorphous silicon photoconductor used in the present invention, the charge injection preventing layer 504, which prevents charges from being injected from the conductive support, is effectively provided between the conductive support 501 and the photoconductive layer 502 in accordance with needs (see FIG. 17C). The charge injection preventing layer 504 has a so-called polarity dependency; i.e., has the function of preventing injection of charges from a support to a photoconductive layer which has been positively (negatively) charged on its free surface, but does not have the function of preventing injection of charges from a support to a photoconductive layer which has been negatively (positively) charged on its free surface. In order for the charge injection preventing layer 504 to have such a function, an atom controlling conductivity is incorporated into it in a higher amount than into the photoconductive layer 502. The thickness of the charge injection preventing layer 504 is preferably 0.1 μm to 5 μm, more preferably 0.3 μm to 4 μm, optimally 0.5 μm to 3 μm, from the viewpoints of, for example, attaining desired electrophotographic characteristics and being economically advantageous.

Regarding Photoconductive Layer

The photoconductive layer 502 is formed on an underlying layer in accordance with needs. The thickness of the photoconductive layer 502 is determined as desired in consideration of, for example, attaining desired electrophotographic characteristics and being economically advantageous. It is preferably 1 μm to 100 μm, more preferably 20 μm to 50 μm, optimally 23 μm to 45 μm.

Regarding Charge Transport Layer

The charge transport layer 506 is one layer of a functionally separated photoconductive layer 502 and mainly transports charges. The charge transport layer 506 contains, as a constituent component, at least a silicon atom, a carbon atom and a fluorine atom. If necessary, it is made of a-SiC(H, F, O) containing a hydrogen atom and an oxygen atom. The charge transport layer has desired photoconductive characteristics, among others, charge retaining characteristics, charge generating characteristics and charge transporting characteristics. In the present invention, it particularly preferably contains an oxygen atom. The thickness of the charge transport layer 506 is determined as desired in consideration of, for example, attaining desired electrophotographic characteristics and being economically advantageous. It is preferably 5 μm to 50 μm, more preferably 10 μm to 40 μm, optimally 20 μm to 30 μm.

Regarding Charge Generation Layer

The charge generation layer 505 is one layer of a functionally separated photoconductive layer 502 and mainly generates charges. The charge generation layer 505 contains, as a constituent component, at least a silicon atom but does not substantially contain a carbon atom. If necessary, it is made of a-Si:H containing a hydrogen atom. The charge generation layer has desired photoconductive characteristics, among others, charge generating characteristics and charge transporting characteristics. The thickness of the charge generation layer 505 is determined as desired in consideration of, for example, attaining desired electrophotographic characteristics and being economically advantageous. It is preferably 0.5 μm to 15 μm, more preferably 1 μm to 10 μm, optimally 1 μm to 5 μm.

Regarding Surface Layer

In the amorphous silicon photoconductor 500 of the present invention, if necessary, the surface layer 503 may be further provided on the photoconductive layer 502 formed on the support as described above. Preferably, an amorphous silicon-based surface layer is formed. The surface layer 503 has a free surface and is provided for the purpose of desirably attaining, among others, humidity resistance, durability to continuous, repetitive use, electric pressure resistance, resistance to environmental factors and durability, to such an extent that the objects of the present invention are achieved. In the present invention, the thickness of the surface layer 503 is generally 0.01 μm to 3 μm, preferably 0.05 μm to 2 μm, optimally 0.1 μm to 1 μm. When the thickness is smaller than 0.01 μm, the surface layer is lost due to, for example, ablation of the photoconductor during use. Whereas when the thickness is greater than 3 μm, electrophotographic characteristics degrade (e.g., increase in residual potential).

Also, the image bearing member used in the image forming apparatus of the present invention may be an organic photoconductor having a surface layer reinforced with a filling material, an organic photoconductor formed by using a cross-linkable charge transport material, or an organic photoconductor having a surface layer reinforced with a filling material and formed by using a cross-linkable charge transport material.

The outermost layer of such a photoconductor is made of polymer or copolymer of a compound(s) selected from vinyl fluoride, vinylidene fluoride, chlorotrifluoroethylene, tetrafluoroethylene, hexafluoropropylene and perfluoroalkyl vinyl ether. The conductive support used is a cylinder or film made of metal (e.g., aluminum and stainless steel), paper or plastic. On the support may be provided an underlying layer (adhesion layer) having the barrier and adhesion functions. The underlying layer is formed for the purposes of, for example, improving adhesion between the photoconductive layer and the support, coating property and injection property of charges from the support; protecting the support and the photoconductive layer from electric coverage; and covering defects in the support. Examples of known materials for the underlying layer include polyvinyl alcohol, poly-N-vinylimidazole, polyethylene oxide, ethyl cellulose, methyl cellulose, ethylene-acrylic copolymers, casein, polyamides, nylon copolymers, glue and gelatin. Each of the materials is dissolved in a suitable solvent and applied onto the support. The thickness of the underlying layer is about 0.2 μm to about 2 μm. The photoconductive layer is classified into a laminated photoconductive layer consisting of a charge generation layer containing a charge generating compound and a charge transport layer containing a charge transport compound, and a single photoconductive layer containing a charge generating compound and a charge transport compound. Examples of the charge generating compound which can be used include pyrylium, thiopyrylium dyes, phthalocyanine pigments, anthoanthoron pigments, dibenzopyrene quinone pigments, pyranthoron pigments, trisazo pigments, disazo pigments, azo pigments, indigo pigments, quinacridone pigments, asymmetric quinocyanines and quinocyanines. Example of the charge transport compound which can be used include pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N,N-diphenylhydrazone, triarylmethane compounds (e.g., p-diethylaminobenzaldehyde-2-methylphenyl)-phenylmethane), polyarylalkanes (e.g., 1,1-bis(4-N,N-diethylamino-2-methylphenyl)heptane and 1,1,2,2-tetrakis(4-N,N-dimethylamino-2-methylphenyl)ethane) and triarylamines.

Also, the image bearing member used in the image forming apparatus of the present invention may be a photoconductor having a protective layer into which a filler has been incorporated for the purpose of imparting enhanced ablation resistance thereto. Examples of the filler include organic fillers such as fluorine resin powder (e.g., polytetrafluoroethylene powder), silicone resin powder and α-carbon powder; inorganic fillers such as powders of metals (e.g., copper, tin, aluminum and indium), metal oxides (e.g., tin oxide, zinc oxide, titanium oxide, indium oxide, antimony oxide, bismuth oxide, tin oxide doped with antimony, and indium oxide doped with tin); and inorganic materials (e.g., potassium titanate). These fillers may be used individually or in combination, and may be dispersed in a protective layer coating liquid using an appropriate disperser. The filler preferably has an average particle diameter of 0.5 μm or lower, preferably 0.2 μm or lower, in consideration of transmittance of a protective layer formed. Furthermore, in the present invention, a plasticizer and/or a leveling agent may be incorporated into the protective layer.

Example 4

The image forming apparatus of the present invention has the cleaning device 14 configured such that desired cleaning performance can be maintained for a long time as described above. Thus, coloring powder used in a developer for image formation may be a toner having a shape factor (SF) 1 of 100 to 150.

Figure 18:
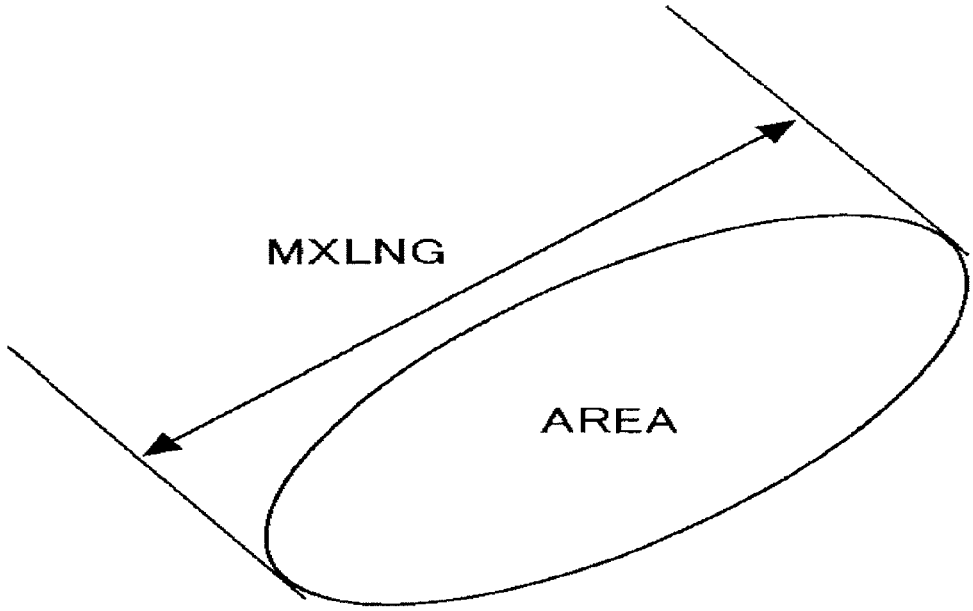
FIG. 18 is an explanatory illustration in relation to definition of shape factor (SF) 1.

Here, as shown in FIG. 18, the shape factor (SF) 1 refers to a value indicating sphericity of a spherical substance, which is obtained as follows. Specifically, the shadow of a spherical substance is cast on a two-dimensional plane to form an ellipsoidal projection image. Subsequently, the maximum length MXLNG of the image is multiplied by itself. The thus-obtained value is divided by an image area AREA, and then multiplied by 100π/4. That is, the shape factor (SF) 1 is defined as being a value calculated by the following equation.

$$SF1=\{(MXLNG)^2/AREA\}\times(100\pi/4)$$

In the image forming apparatus of the present invention, the cleaning device 14 having the above-described configuration can effectively remove/recover even a toner having such a shape factor (i.e., spherical toner).

The above embodiments and Examples describe a monochromatic image forming apparatus having the cleaning device of the present invention. In addition, the cleaning device of the present invention may be suitably used for cleaning a photoconductor, an intermediate transfer member, etc. in a multi-color image forming apparatus. Next will be given Examples using a multi-color image forming apparatus.

Example 5

Figure 19:
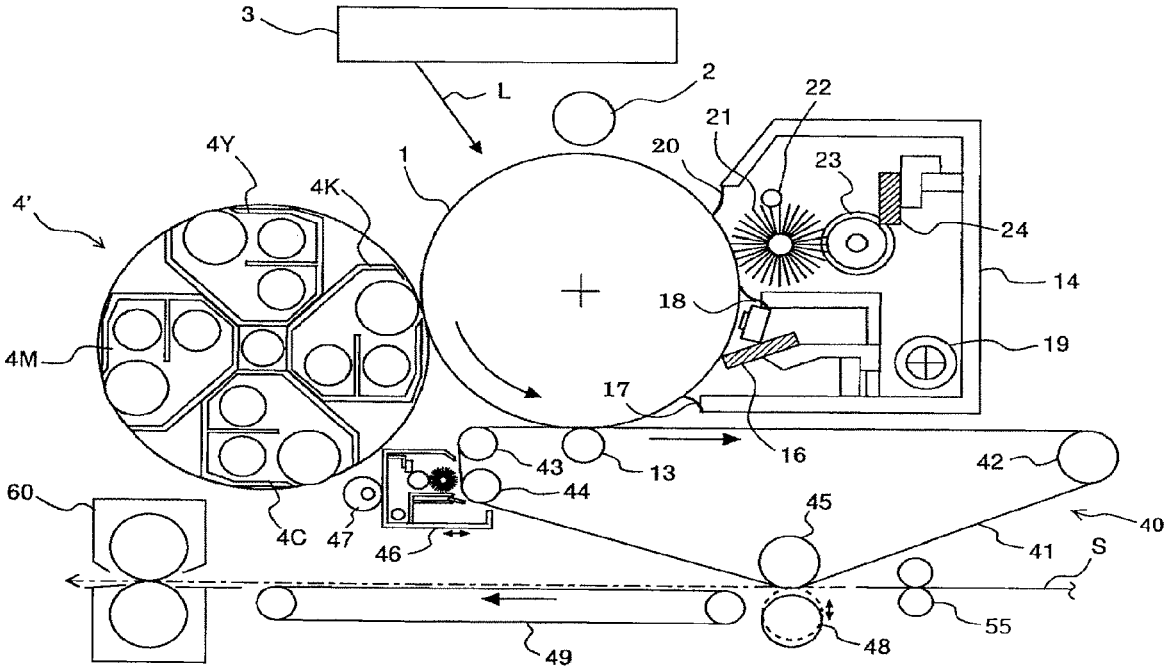
FIG. 19 schematically illustrates essential parts of an exemplary multi-color image forming apparatus employing a cleaning device of the present invention.

FIG. 19 schematically illustrates essential parts of an exemplary multi-color image forming apparatus employing the cleaning device of the present invention. This multi-color image forming apparatus has one image bearing member 1, a charging unit 2, an optical writing unit 3, a plurality of developing units 4Y, 4M, 4C and 4K which form an image on an image bearing member with coloring powder, a primary transfer device 40 which transfers the image from the image bearing member onto an intermediate transfer member 41, a secondary transfer device 48 which transfers the image from the intermediate transfer member 41 onto a recording medium S, a fixing device 60 and an unillustrated paper feeding mechanism.

The image bearing member 1 is a photoconductor drum and is rotated counterclockwise; i.e., in a direction indicated by an arrow in FIG. 19.

The charging unit 2 is, for example, a charging roller disposed in a non-contact manner, and uniformly charges the surface of the photoconductor drum 1.

The optical writing unit 3 is, for example, an optical writing device employing laser light scanning which includes a laser light source, a coupling optical system, a light polarizer and a scanning imaging optical system. This applies laser light L, which is modulated correspondingly to image signals, to a charged photoconductor drum 1 to form a latent electrostatic image.

The developing units are a yellow toner-developing device 4Y which uses a yellow toner as a coloring powder of a developer, a magenta toner-developing device 4M which uses a magenta toner as the coloring powder, a cyan toner-developing device 4C which uses a cyan toner as the coloring powder, and a black toner-developing device 4K which uses a black toner as the coloring powder. These four developing devices are housed in a rotary developing device 4'. The rotary developing device 4' is rotated so that the developing device of a color selected is located so as to face the photoconductor drum 1. The configurations of the developing devices are identical to one another. Each developing device has, in a case thereof, a developing roller for developing a latent image on the photoconductor drum with a toner carried/conveyed thereon, a doctor blade for controlling the amount of a developer on the developing roller, a developing screw for stirring/conveying the developer, and other members.

The primary transfer device 40 uses an intermediate transfer belt 41 as the intermediate transfer member. The intermediate transfer belt 41 is rotated in a direction indicated by an arrow in FIG. 19 with being supported by a driving roller 42 and a plurality of driven rollers 43, 44 and 45, and a transfer bias-applying roller, so that an image (toner image) on the photoconductor drum is transferred onto the intermediate transfer belt.

The secondary transfer device 48 uses a secondary transfer roller which conveys a recording medium (e.g., a recording paper sheet) S which has been fed by the unillustrated paper feeding mechanism and then transfers the image (toner image) from the intermediate transfer belt onto the recording medium S. The secondary transfer roller is disposed such that it can contact with or separate from the intermediate transfer belt 41. When a toner image is primarily transferred from the photoconductor drum 1 onto the intermediate transfer belt 41, the secondary transfer roller is spaced from the intermediate transfer belt 41. Then, upon secondarily transferring the toner image from the intermediate transfer belt onto a recording medium S, the secondary transfer roller 48 contacts with the intermediate transfer belt 41 for secondary transfer.

Also, downstream of the secondary transfer device 48 in a direction in which a recording medium is fed, there are provided a conveyor belt 49 for conveying a recording medium S having undergone image transfer, a fixing device 60 for fixing the transferred image on the recording medium S through application of, for example, heat and pressure, and other members.

The cleaning unit 14 for the image bearing member has the same configuration as that shown in FIG. 1. It is a cleaning device which includes a toner polarity controlling blade 16 disposed so as to contact the photoconductor drum 1 to be cleaned; a cleaning brush roller 21 disposed so as to contact the photoconductor drum 1 downstream of the toner polarity controlling blade 16 in a direction in which a toner is conveyed; a recovering roller 23 disposed so as to contact the cleaning brush roller 21; and a recovering roller conductive cleaning blade 24 disposed so as to contact the recovering roller 23. Here, the toner polarity controlling blade 16 is a conductive member configured to charge toner particles remaining on the photoconductor drum so as to have a single polarity when a predetermined voltage is applied from a power source (toner polarity controlling blade-power source) 27, and configured to scrape off at least part of the remaining toner particles. The cleaning brush roller 21 is a cleaning member configured to electrically adsorb toner particles present on the photoconductor drum when a predetermined voltage is applied from a power source (cleaning brush shaft voltage applying power source 30 and brush tip voltage applying power source 31). The recovering roller 23 is a first recovering member configured to electrically adsorb toner particles present on the cleaning brush roller 21 when a predetermined voltage is applied from a power source (recovering roller shaft voltage applying power source) 28. The recovering roller conductive cleaning blade 24 is a second recovering member configured to scrape off toner particles on the recovering roller 23 when a predetermined voltage is applied from a power source (recovering roller conductive cleaning blade power source) 29.

The cleaning device 14 has a cleaning case, and opening sections of the cleaning case are provided with a cleaning inlet seal 17, a cleaning brush inlet seal 18 and a cleaning outlet seal 20, so that toner particles recovered from the photoconductor drum 1 does not leak outside the case. Also, a toner discharging screw 19 is disposed in a lower portion of the cleaning case. The toner discharging screw discharges recovered toner particles to, for example, an unillustrated waste toner container.

Furthermore, the cleaning unit (device) 14 has a quenching member (e.g., a quenching lamp) 26 which charge-quenches a photoconductor drum 1 and is located downstream of the toner polarity controlling blade 16 but upstream of the cleaning brush roller 21 in a direction in which the photoconductor drum 1 is rotated.

The primary transfer device 40 is provided with an intermediate transfer belt cleaning device 46 which removes/recovers toner particles remaining on the intermediate transfer belt 41 having undergone secondary transfer. The intermediate transfer belt cleaning device 46 may have a similar configuration to the photoconductor drum cleaning device 14. But, in this case, no quenching member is required. Also, the intermediate transfer belt cleaning device 46 is disposed such that it can contact with or separate from the intermediate transfer belt 41 by a mechanism 47 such as a cam. When a toner image is primarily transferred from the photoconductor drum 1 onto the intermediate transfer belt 41, the cleaning device is spaced from the intermediate transfer belt 41. Then, upon secondarily transferring the toner image from the intermediate transfer belt onto a recording medium S, the intermediate transfer belt cleaning device 46 contacts with the intermediate transfer belt 41 and then removes/recovers toner particles remaining on the surface of the intermediate transfer belt having undergone secondary transfer.

Next will be described the operation of the multi-color image forming apparatus having the configuration shown in FIG. 19.

A series of image forming processes in this image forming apparatus include non-contact charging employing a non-contact charging roller 2, latent image formation, and N/P development (nega/posi development; i.e., toner particles adhere to a portion whose electrical potential is low).

First of all, monochromatic image formation or color image formation is selected at an unillustrated operation part (here, color image formation is selected and a Y toner image, an M toner image, a C toner image and a K toner image are formed in this order). When a print button is pressed, a rotary developing device 4' is rotated so that a yellow-toner developing device 4Y is located so as to face a photoconductor drum 1. Then, a predetermined voltage or current is sequentially applied at a predetermined timing to a non-contact charging roller 2, a developing roller of the yellow-toner developing device 4Y, a transfer bias-applying roller 13 for a primary transfer device 40, a toner polarity controlling blade 16, a cleaning brush roller 21 and a recovering roller 23. Almost simultaneously with this, the photoconductor drum 1, the non-contact charging roller 2, an intermediate transfer belt 41 of the primary transfer device 40, a developing roller and a developing screw of the yellow-toner developing device 4Y, a cleaning brush roller 21, a recovering roller 23 and a toner discharging screw 19 each begin to rotate in predetermined directions. The photoconductor drum 1 is uniformly negatively charged by the non-contact charging roller 2 disposed in a non-contact manner, and then is exposed to laser light L emitted from an optical writing device 3 to form a latent image to be developed with a yellow toner. The thus-formed latent image is developed with a yellow toner magnetic brush on the developing roller to form a yellow toner image. The yellow toner image is primarily transferred onto the intermediate transfer belt 41 with the aid of transfer bias brought by the transfer bias-applying roller 13. Then, toner particles remaining on the photoconductor drum 1 having undergone primary transfer are removed/recovered by the photoconductor cleaning device 14. Notably, the configuration and operation of the cleaning device 14 are the same as those as described above in FIG. 1 and thus, no description about them is given.

After the above-described primary transfer, the rotary developing device 4' is rotated so that the next magenta toner-developing device 4M is located so as to face the photoconductor drum 1. Then, similar to the above, the photoconductor drum 1 having undergone cleaning is subjected to charging, latent image formation and developing, to thereby form a magenta toner image on the photoconductor drum. Subsequently, the magenta toner image is primarily transferred onto the yellow toner image on the intermediate transfer belt 41 with the aid of transfer bias brought by the transfer bias-applying roller 13, whereby a composite toner image is formed. Then, toner particles remaining on the photoconductor drum 1 having undergone primary transfer are removed/recovered by the photoconductor cleaning device 14.

In addition, the above-described process (i.e., switching of a developing device, charging, latent image formation, developing, primary transfer and photoconductor cleaning) is repeated twice to form cyan and black toner images, whereby a composite toner image of four colors is formed on the intermediate transfer belt 41.

In synchronization with primary transfer of a toner image of the fourth color onto the intermediate transfer belt 41, the secondary transfer roller 48 comes into contact with the intermediate transfer belt. Then, the composite image of four color toner images is secondarily transferred at one time onto a recording paper S which has been fed by an unillustrated paper feeding mechanism to between the intermediate transfer belt 41 and the secondary transfer roller 48 so as to synchronize with the top end of the toner image by a resist roller 55. The recording paper S is separated from the intermediate transfer belt 41 by an unillustrated separating mechanism, and then is discharged as a print (or copy) image through a transfer belt 49 and a fixing device 60.

Also, in synchronization with secondary transfer, the intermediate transfer belt cleaning device 46 is moved so as to be in contact with the intermediate transfer belt 41, and then removes/recovers toner particles remaining on the intermediate transfer belt having undergone secondary transfer.

After secondary transfer, the secondary transfer roller 48 is spaced from the intermediate transfer belt 41, and the intermediate transfer belt cleaning device 46 after cleaning is also spaced from the intermediate transfer belt 41, whereby the image forming apparatus is ready for the next image formation.

Example 6

Next will be described a multi-color image forming apparatus having another configuration.

Figure 20:
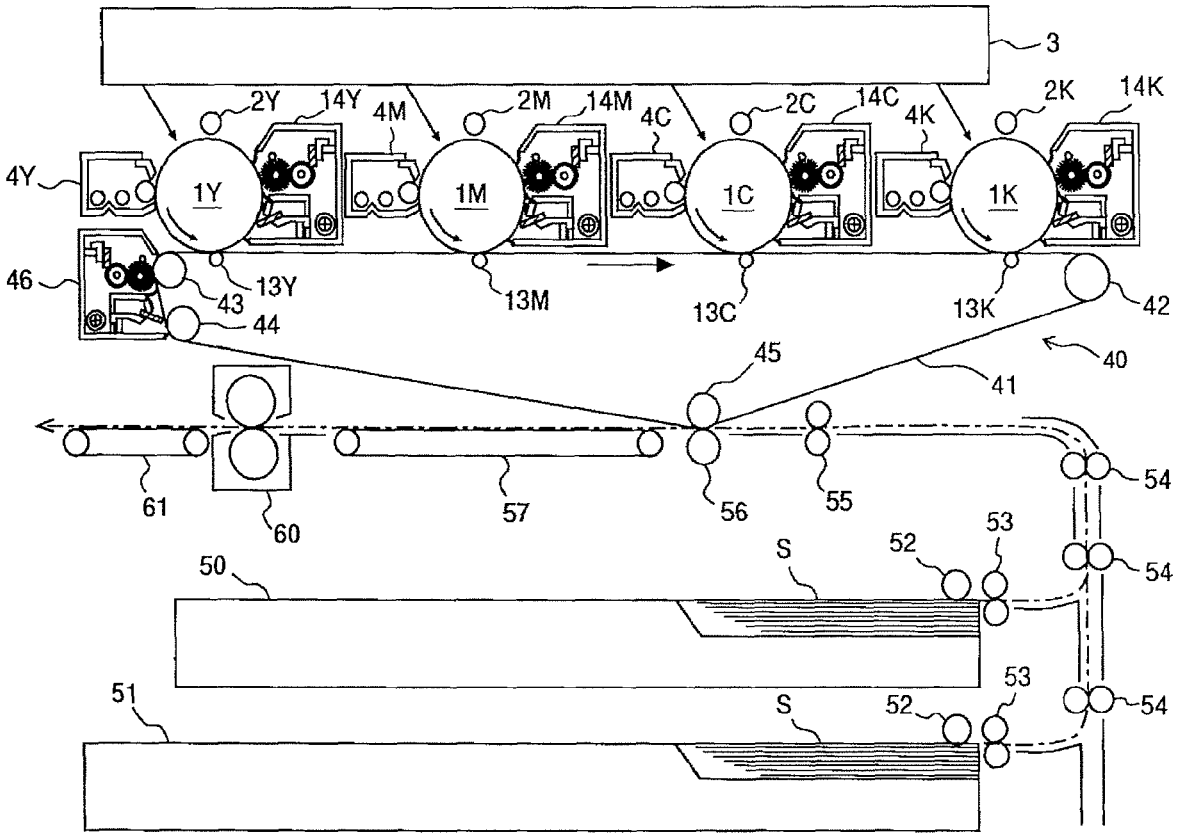
FIG. 20 schematically illustrates essential parts of another exemplary multi-color image forming apparatus employing a cleaning device of the present invention.

FIG. 20 schematically illustrates essential parts of another exemplary multi-color image forming apparatus employing the cleaning device of the present invention. The multi-color image forming apparatus is a so-called tandem multi-color image forming apparatus having four image forming sections disposed in a row along an intermediate transfer belt 41 of a primary transfer device 40.

The four image forming sections are identical in configuration to one another, except that colors used in developing units are different from one another (i.e., yellow (Y), magenta (M), cyan (C) or black (K)). Taking for example an image forming section using a yellow (Y) toner, this includes an image bearing member 1Y, a charging unit 2Y, an exposed area to laser light emitted from an optical writing unit 3, a developing unit 4Y, a primary transfer unit 13Y and a cleaning unit 14Y. Notably, among the constituent members of the image forming section, the image bearing member 1Y, the charging unit 2Y, the developing unit 4Y and the cleaning unit 14Y are housed in one cartridge to form a process cartridge. The process cartridge is detachably mounted to an image forming apparatus main body.

Each image forming section has the same configuration as shown in FIG. 1. The image bearing members 1Y, 1M, 1C and 1K are photoconductor drums and are rotated counterclockwise; i.e., in a direction indicated by an arrow in FIG. 20.

The charging units 2Y, 2M, 2C and 2K are, for example, charging rollers disposed in a non-contact manner, and uniformly charge the surface of the photoconductor drum.

The optical writing unit 3 is, for example, an optical writing device employing laser light scanning which includes four laser light sources and coupling optical systems, one light polarizer and four scanning imaging optical systems. This applies laser light, which is modulated correspondingly to image signals, to charged photoconductor drums 1Y, 1M, 1C and 1K to form latent electrostatic images.

The developing units 4Y, 4M, 4C and 4K are developing devices containing, in cases, respectively a yellow toner, a magenta toner, a cyan toner and a black toner as coloring powders; i.e., as toners used as one- or two-component developers. Each case houses, for example, a developing roller for carrying/conveying a developer to develop a latent image on the photoconductor drum with toner; a doctor blade for controlling the amount of the developer carried on the developing roller; and developing screws which stir the developer to convey it.

The image bearing member cleaning units 14Y, 14M, 14C and 14K each have the same configuration as shown in FIG. 1. Here, reference numerals are not given. Each cleaning unit is a cleaning device which includes a toner polarity controlling blade 16 disposed so as to contact the photoconductor drum 1Y, 1M, 1C or 1K to be cleaned; a cleaning brush roller 21 disposed so as to contact the photoconductor drum 1Y, 1M, 1C or 1K downstream of the toner polarity controlling blade 16 in a direction in which a toner is conveyed; a recovering roller 23 disposed so as to contact the cleaning brush roller 21; and a recovering roller conductive cleaning blade 24 disposed so as to contact the recovering roller 23. Here, the toner polarity controlling blade 16 is a conductive member configured to charge toner particles remaining on the photoconductor drum so as to have a single polarity when a predetermined voltage is applied from a power source (toner polarity controlling blade-power source) 27, and configured to scrape off at least part of the remaining toner particles. The cleaning brush roller 21 is a cleaning member configured to electrically adsorb toner particles present on the photoconductor drum when a predetermined voltage is applied from a power source (cleaning brush shaft voltage applying power source 30 and brush tip voltage applying power source 31). The recovering roller 23 is a first recovering member configured to electrically adsorb toner particles present on the cleaning brush roller 21 when a predetermined voltage is applied from a power source (recovering roller shaft voltage applying power source) 28. The recovering roller conductive cleaning blade 24 is a second recovering member configured to scrape off toner particles on the recovering roller 23 when a predetermined voltage is applied from a power source (recovering roller conductive cleaning blade power source) 29.

The primary transfer device 40 uses an intermediate transfer belt 41 as the intermediate transfer member. The intermediate transfer belt 41 is rotated in a direction indicated by an arrow in FIG. 20 with being supported by a driving roller 42 and a plurality of driven rollers 43, 44 and 45, and a transfer bias-applying roller, so that images (toner images) on photoconductor drums of image forming sections are sequentially transferred onto the intermediate transfer belt, to thereby form a composite toner image.

The secondary transfer device 56 uses a secondary transfer roller which conveys a recording medium S (e.g., a recording paper sheet), which has been fed through a paper feeding roller 52, separating rollers 53, conveying rollers 54, resist rollers 55, and other paper-feeding mechanisms from a selected paper-feeding part (e.g., a paper-feeding tray or a paper-feeding cassette) 50 or 51, and which transfers an image from the intermediate transfer belt onto the recording medium S.

Also, downstream of the secondary transfer device 56 in a direction in which a recording medium is fed, there are provided a conveyor belt 48 for conveying a recording medium having undergone image transfer, a fixing device 60 for fixing the transferred image on the recording medium S through application of, for example, heat and pressure, a paper-discharging device 61 and other members.

The primary transfer device 40 is provided with an intermediate transfer belt cleaning device 46 which removes/recovers toner particles remaining on the intermediate transfer belt 41 having undergone secondary transfer. The intermediate transfer belt cleaning device 46 may have a similar configuration to the photoconductor drum cleaning device 14. But, in this case, no quenching member is required.

Next will be described the operation of the multi-color image forming apparatus having the configuration shown in FIG. 20.

First of all, monochromatic image formation or color image formation is selected at an unillustrated operation part (here, color image formation is selected and a Y toner image, an M toner image, a C toner image and a K toner image are formed in this order). When a print button is pressed, each image forming section begins to operate. Then, a predetermined voltage or current is sequentially applied at a predetermined timing to non-contact charging rollers 2Y, 2M, 2C and 2K; developing rollers of developing devices 4Y, 4M, 4C and 4K; transfer bias-applying rollers 13Y, 13M, 13C and 13K of a primary transfer device 40; toner polarity controlling blades 16, cleaning brush rollers 21 and recovering rollers 23 of cleaning devices 14Y, 14M, 14C and 14K (and an intermediate transfer belt cleaning device 46). Almost simultaneously with this, photoconductor drums 1Y, 1M, 1C and 1K; the non-contact charging rollers 2Y, 2M, 2C and 2K; an intermediate transfer belt 41 of the primary transfer device 40; the developing rollers and the developing screws of the developing devices 4Y, 4M, 4C and 4K; the cleaning brush rollers 21; the recovering rollers 23; and toner discharging screws 19 each begin to rotate in predetermined directions. The photoconductor drums 1Y, 1M, 1C and 1K each are uniformly negatively charged by the corresponding non-contact charging rollers 2Y, 2M, 2C and 2K disposed in a non-contact manner, and then are exposed to laser light L emitted from an optical writing device 3 to form latent images to be developed with color toners. The thus-formed latent images are developed with magnetic brushes each being formed of each color toner and formed on the developing roller of the developing device 4Y, 4M, 4C or 4K, to thereby form toner images corresponding to each color toner. The toner images are primarily transferred, in sequence, onto the intermediate transfer belt 41 so as to form a composite toner image with the aid of transfer bias brought by the transfer bias-applying roller 13Y, 13M, 13C or 13K. Then, toner particles remaining on the photoconductor drums 1Y, 1M, 1C and 1K having undergone primary transfer are removed/recovered by the photoconductor cleaning devices 14Y, 14M, 14C and 14K. Notably, the configuration and operation of the cleaning device 14Y, 14M, 14C or 14K are the same as those as described above in FIG. 1 and thus, no description about them is given.

In synchronization with primary transfer of a toner image of the fourth color onto the intermediate transfer belt 41, a recording paper S is fed to between the intermediate transfer belt 41 and the secondary transfer roller 48 so as to synchronize with the top end of the composite toner image by resist rollers 55 through a paper feeding roller 52, separating rollers 53, conveying rollers 54, and other paper-feeding mechanisms from a selected paper-feeding part (e.g., a paper-feeding tray or a paper-feeding cassette) 50 or 51. Then, the composite image of four color toner images is secondarily transferred at one time onto the recording paper S. The recording paper S is separated from the intermediate transfer belt 41 by an unillustrated separating mechanism, and then is discharged as a print (or copy) image through a conveyor belt 57, a fixing device 60 and a paper-discharging device 61.

After secondary transfer, toner particles remaining on the surface of the intermediate transfer belt are removed/recovered by the intermediate transfer belt cleaning device 46.

FIG. 20 illustrates the configuration of an exemplary tandem multi-color image forming apparatus based on the intermediate transfer method using the intermediate transfer belt 41 serving as the primary transfer device 40. Alternatively, there may be achieved a tandem multi-color image forming apparatus based on the direct transfer method in which toner images on photoconductor drums are transferred onto a recording medium to form a composite image, using, instead of the intermediate transfer belt, a transfer member (transfer belt) which carries/conveys a recording medium to each image forming section. In this case, no secondary transfer device is required. Also, a transfer belt cleaning device, which is provided in this image forming apparatus for cleaning the surface of a transfer belt after conveyance of a recording medium, may have the same configuration as the photoconductor cleaning device as shown in FIG. 1.

What is claimed is:

1. A cleaning device which removes and recovers powder remaining after image formation on a member to be cleaned, with being mounted to an image forming apparatus performing image formation using coloring powder, the cleaning device comprising:

a conductive member configured to charge the powder remaining on the member to be cleaned through application of a predetermined voltage so as to have a single polarity and configured to scrape off at least part of the powder remaining on the member to be cleaned, the conductive member being disposed so as to be in contact with the member to be cleaned;

a cleaning member configured to electrically adsorb the powder present on the member to be cleaned through application of a predetermined voltage, the cleaning member being disposed so as to be in contact with the member to be cleaned and located downstream of the conductive member in a direction in which the powder is conveyed on the member to be cleaned;

a first recovering member configured to electrically adsorb the powder present on the cleaning member through application of a predetermined voltage, the first recovering member being disposed so as to be in contact with the cleaning member; and a second recovering member configured to scrape off the powder from the first recovering member through application of a predetermined voltage, the second recovering member being disposed so as to be in contact with the first recovering member, wherein the conductive member is constant-current controlled.

2. The cleaning device according to claim 1, wherein the member to be cleaned is any one of an image bearing member on which an image is formed with the coloring powder and which transfers the image onto an intermediate transfer member or a recording medium; an intermediate transfer member onto which the image on the image bearing member is transferred; and a transfer member which conveys a recording medium and transfers, onto the recording medium, the image on the image bearing member or the intermediate transfer member.

3. The cleaning device according to claim 1, wherein the coloring powder is a toner having a shape factor 1 (SF1) of 100 to 150.

4. The cleaning device according to claim 1, wherein the member to be cleaned is an image bearing member which is a photoconductor, and the cleaning device further comprises a quenching member configured to quench the image bearing member, the quenching member being provided downstream of the conductive member but upstream of the cleaning member in a direction in which the image bearing member is rotated.

5. An image forming apparatus comprising:

an image bearing member, an image forming unit configured to form an image with coloring powder on the image bearing member, a transfer unit configured to transfer the image formed on the image bearing member onto a recording medium, and a cleaning unit configured to remove and recover powder remaining on a member to be cleaned, wherein the cleaning unit is a cleaning device which comprises a conductive member configured to charge the powder remaining on the member to be cleaned through application of a predetermined voltage so as to have a single polarity and configured to scrape off at least part of the powder remaining on the member to be cleaned, the conductive member being disposed so as to be in contact with the member to be cleaned; a cleaning member configured to electrically adsorb the powder present on the member to be cleaned through application of a predetermined voltage, the cleaning member being disposed so as to be in contact with the member to be cleaned and located downstream of the conductive member in a direction in which the powder is conveyed on the member to be cleaned; a first recovering member configured to electrically adsorb the powder present on the cleaning member through application of a predetermined voltage, the first recovering member being disposed so as to be in contact with the cleaning member; and a second recovering member configured to scrape off the powder from the first recovering member through application of a predetermined voltage, the second recovering member being disposed so as to be in contact with the first recovering member, and wherein the conductive member is constant-current controlled.

6. The image forming apparatus according to claim 5, wherein the transfer unit is a unit configured to transfer the image formed on the image bearing member onto the recording medium directly or via an intermediate transfer member, and the member to be cleaned is the image bearing member from which the image has been transferred onto the recording medium or the intermediate transfer member.

7. The image forming apparatus according to claim 5, wherein the transfer unit is a transfer member configured to carry and convey a recording medium and to transfer the image formed on the image bearing member onto the recording medium, and the member to be cleaned is the transfer member which has conveyed the recording medium.

8. The image forming apparatus according to claim 5, wherein the transfer unit comprises a transfer unit configured to transfer the image formed on the image bearing member onto an intermediate transfer member and a transfer unit configured to transfer the transferred image on the intermediate transfer member onto a recording medium, and the member to be cleaned is the intermediate transfer member from which the transferred image has been transferred onto the recording medium.

9. The image forming apparatus according to claim 5, wherein the image bearing member is one in number, the image forming unit is a plurality of developing units, the transfer unit is a unit configured to transfer the images formed on the image bearing member onto a recording medium directly or via an intermediate transfer member, and the member to be cleaned is the image bearing member from which the images have been transferred onto the recording medium or the intermediate transfer member.

10. The image forming apparatus according to claim 5, wherein the image bearing member is one in number, the image forming unit is a plurality of developing units, the transfer unit comprises a transfer unit configured to transfer the images formed on the image bearing member onto an intermediate transfer member and a transfer unit configured to transfer the transferred images on the intermediate transfer member onto a recording medium, the member to be cleaned is the intermediate transfer member from which the transferred images have been transferred onto the recording medium.

11. The image forming apparatus according to claim 5, wherein the image bearing member and the image forming unit are included in an image forming section, the image forming unit is a developing unit, the image forming section is two or more in number, the transfer unit is a unit configured to sequentially transfer the images formed on the image bearing members of the image forming sections onto a recording medium or an intermediate transfer member in a superposed manner, and the member to be cleaned is the image bearing members from which the images have been transferred onto the recording medium or the intermediate transfer member.

12. The image forming apparatus according to claim 5, wherein the image bearing member and the image forming unit are included in an image forming section, the image forming unit is a developing unit, the image forming section is two or more in number, the transfer unit is a transfer member configured to convey a recording medium sequentially to the image forming sections and to sequentially transfer the images formed on the image bearing members onto the recording medium in a superposed manner, and the member to be cleaned is the transfer member which has conveyed the recording medium.

13. The image forming apparatus according to claim 5, wherein the image bearing member and the image forming unit are included in an image forming section, the image forming unit is a developing unit, the image forming section is two or more in number, the transfer unit comprises a transfer unit configured to sequentially transfer the images formed on the image bearing members of the image forming sections onto an intermediate transfer member in a superposed manner and a transfer unit configured to transfer the transferred and superposed image on the intermediate transfer member onto a recording medium at one time, and the member to be cleaned is the intermediate transfer member from which the transferred image has been transferred onto the recording medium.

14. The image forming apparatus according to claim 5, wherein the image bearing member is a photoconductor comprising a filler dispersed therein.

15. The image forming apparatus according to claim 5, wherein the image bearing member is an organic photoconductor having a surface layer reinforced with a filling material, an organic photoconductor containing a cross-linkable charge transport material, or an organic photoconductor having a surface layer reinforced with a filling material and containing a cross-linkable charge transport material.

16. The image forming apparatus according to claim 5, wherein the image bearing member is an amorphous silicon photoconductor.

17. A process cartridge detachably mounted to an image forming apparatus main body, the process cartridge comprising:

an image bearing member, a cleaning unit for the image bearing member, and at least one unit selected from a charging unit and a developing unit, the image bearing member, the cleaning unit, and the at least one unit being integrally supported, wherein the cleaning unit is a cleaning device which removes and recovers powder remaining after image formation on a member to be cleaned, with being mounted to an image forming apparatus performing image formation using coloring powder, wherein the cleaning device comprises a conductive member configured to charge the powder remaining on the member to be cleaned through application of a predetermined voltage so as to have a single polarity and configured to scrape off at least part of the powder remaining on the member to be cleaned, the conductive member being disposed so as to be in contact with the member to be cleaned; a cleaning member configured to electrically adsorb the powder present on the member to be cleaned through application of a predetermined voltage, the cleaning member being disposed so as to be in contact with the member to be cleaned and located downstream of the conductive member in a direction in which the powder is conveyed on the member to be cleaned; a first recovering member configured to electrically adsorb the powder present on the cleaning member through application of a predetermined voltage, the first recovering member being disposed so as to be in contact with the cleaning member; and a second recovering member configured to scrape off the powder from the first recovering member through application of a predetermined voltage, the second recovering member being disposed so as to be in contact with the first recovering member, and wherein the conductive member is constant-current controlled.

* * * * *